US006132119A

United States Patent [19]

Nakajima et al.

[11] Patent Number: 6,132,119

[45] Date of Patent: Oct. 17, 2000

[54] TAPE CARTRIDGE AND TAPE PRINTING APPARATUS

[75] Inventors: Kenichi Nakajima, Shimosuwa-machi; Hideki Oikawa, Shioiiri; Kunihiko Matsuhashi, Matsumato, all of Japan

[73] Assignee: Seiko Epson Corporation, Tokyo, Japan

[21] Appl. No.: 09/124,325

[22] Filed: Jul. 29, 1998

[30] Foreign Application Priority Data

| | | | |
|---|---|---|---|
| Jul. 30, 1997 | [JP] | Japan | 9-219201 |
| Jul. 31, 1997 | [JP] | Japan | 9-220911 |
| Jul. 31, 1997 | [JP] | Japan | 9-220912 |

[51] Int. Cl.[7] ..... B41J 11/30

[52] U.S. Cl. ..... 400/613; 400/207

[58] Field of Search ..... 400/207, 208, 400/242, 613, 613.1, 691, 692, 693, 586, 617

[56] References Cited

U.S. PATENT DOCUMENTS

| | | | |
|---|---|---|---|
| 5,296,084 | 3/1994 | Hattori et al. | 400/613 |
| 5,362,162 | 11/1994 | Takahashi | 400/613 |
| 5,480,242 | 1/1996 | Gunderson | 400/208 |

FOREIGN PATENT DOCUMENTS

| | | | |
|---|---|---|---|
| 7-061100 | 7/1995 | Japan | B41J 32/00 |
| 8-169155 | 7/1996 | Japan | B41J 19/18 |
| 8-230175 | 9/1996 | Japan | B41J 2/01 |

*Primary Examiner*—Ren Yan
*Attorney, Agent, or Firm*—Hogan & Hartson, LLP

[57] ABSTRACT

A tape cartridge holds a roll of printing tape. The tape cartridge is removably loaded in a tape printing apparatus. The printing tape is fed by being unwound from the tape cartridge. Printing is carried out on the printing tape unwound from the tape cartridge by an ink jet printing method. A drive roller for feeding the printing tape is arranged in the apparatus. A driven roller associated with the drive roller is arranged in the tape cartridge. The drive roller and the driven roller press the printing tape therebetween for feeding the printing tape by rotation, in a state of the tape cartridge being loaded in the apparatus body.

28 Claims, 17 Drawing Sheets

TAPE CARTRIDGE AND TAPE PRINTING APPARATUS

BACKGROUND OF THE INVENTION

1. Field of the Invention

This invention relates to a tape cartridge containing a printing tape and a feed roller for feeding the printing tape, and a tape printing apparatus in which the tape cartridge is removably loaded and which carries out color printing on the printing tape unwound from the tape cartridge by the ink jet printing method.

2. Prior Art

Conventionally, there has not been proposed a particular tape printing apparatus of an ink jet type that prints on a tape by the ink jet printing method.

For the tape printing apparatus of the above-mentioned kind, it is contemplated that a set of feed rollers are used for winding out a printing tape from a tape cartridge and guiding the same to a printing position. The feed rollers are comprised e.g. of a drive roller and a driven roller which rotate while holding the tape therebetween for feeding the same to the proper position for printing. On the other hand, in a tape printing apparatus of a type that uses a tape cartridge containing a printing tape, it is required to feed the leading end of the tape between the drive roller and the driven roller when the tape cartridge is loaded into the body of the apparatus. That is, when the tape cartridge is loaded in the body of the apparatus, it is required that the drive roller and the driven roller be separated from each other in order to allow the leading edge of the tape to pass between them. The rollers then must be bought into contact with each other so that friction may be applied to feed the tape. When the tape cartridge is removed from the apparatus body, the drive roller and the driven roller brought into contact are required to be separated from each other once again.

In such a case, since the apparatus body is required to include means for moving either the drive roller or the driven roller in a manner interlocked with the loading/unloading operation of the tape cartridge, it is expected that the construction of the apparatus becomes complicated. Further, when the tape printing apparatus is configured such that various types of printing tapes having different widths can be used, in order to accommodate tapes of maximum width, it is required to employ drive and driven rollers having larger widths compared to the width of the smallest width tapes that can be used. However, when a small-width printing tape is fed by using drive and driven rollers of greater width, there is the potential that the dispersion of the frictional force of the rollers would prevent stable feeding of these printing tapes.

On the other hand, in a tape printing apparatus of a thermal transfer type that prints on a printing tape by the thermal transfer printing method, a tape cartridge is known which is equipped with a platen roller corresponding to a set of feed rollers. When a tape cartridge is loaded in the apparatus, the platen roller and a thermal head of the printing apparatus are opposed to each other with a tape (and an ink ribbon) positioned therebetween, and in a manner interlocked with the closing operation of a lid for a cartridge holding block, the thermal head is urged against the platen roller with the tape held therebetween. The urging of the thermal head is effected by a spring provided on the thermal head side with a desired urging or friction force.

In such a conventional construction of the printing apparatus, the urging force for providing the proper friction between the platen roller and the thermal head is obtained by the spring (urging means) provided on the apparatus. Therefore, a fixed urging force is constantly applied to the tape by the platen roller and the thermal head irrespective of the kind of a tape cartridge, i.e. the kind of a tape. As a result, depending on the kind of a tape, particularly when the tape has a large width or is made of a slippery material, the urging force becomes insufficient to obtain the proper friction to feed the tape in a stable manner. Since the printing operation and the feeding of the tape are interlocked with each other, if the tape cannot be fed in a stable manner, the quality of the print is degraded.

Further, the tape feeder of the above-mentioned kind has a set of feed rollers arranged in the vicinity of printing position, for unwinding the tape from the tape cartridge and feeding the tape to the printing position. To effect proper printing at a desired location of the tape, particularly to guide the tape accurately with respect to the position in the direction of the width of the tape, a tape guide for controlling a lateral position of the tape is arranged at a location prior to the feed rollers, and at the same time the roll of tape is provided on a core such that the roll on the core agrees with the tape in position.

In the case of such a conventional tape feeder, if the position of a roll of tape on its core is deviated in an axial direction, or the roll itself has turns deviated axially at a radial location of the roll, a portion of the tape unwound from the tape cartridge and the tape guide go out of alignment and the tape receives improper forces to produce wrinkles or undergo jamming.

SUMMARY OF THE INVENTION

It is a first object of the invention to provide a tape printing apparatus which permits simplified configuration thereof and is capable of feeding printing tapes with various tape widths in a stable manner.

It is a second object of the invention to provide a tape cartridge which can press a tape between a feed driven roller and a feed drive roller with an urging force appropriate for stable feeding of the tape in a manner adapted to a material of the tape, and a tape printing apparatus that uses the tape cartridge.

To attain the first and second objects, according to a first aspect of the invention, there is provided a tape printing apparatus comprising:

a tape cartridge for containing a roll of printing tape;

an apparatus body for removably mounting the tape cartridge therein;

a printing tape feeder for feeding the printing tape by unwinding the roll of printing tape; and a printing device for printing on the printing tape unwound from the roll of printing tape by an ink jet printing method;

the printing tape feeder comprising:

a feed drive roller arranged in the apparatus body; and a feed driven roller arranged in the tape cartridge;

the feed drive roller and the feed driven roller pressing the printing tape therebetween for feeding the printing tape by rotation thereof, in a state of the tape cartridge being loaded in the apparatus body.

According to this tape printing apparatus, the feed driven roller is arranged in a tape cartridge for being removably loaded in the apparatus body and hence when the tape cartridge is loaded in the body, the feed driven roller rotates in rolling contact with the feed drive roller, whereas when the tape cartridge is removed from the body, the feed driven roller is separated from the feed drive roller. Therefore, it is possible to omit a dedicated mechanism for moving the feed driven roller for positioning. Further, the feed driven roller may be designed to have a width corresponding to that of a printing tape contained in the tape cartridge, to exert the appropriate urging force to the feed drive roller.

Preferably, the tape cartridge has a casing and a casing lid attached to the casing, the feed driven roller being arranged in the casing lid.

According to this preferred embodiment, since the feed driven roller is attached to the casing lid, the roll of printing tape can be placed in the casing with a leading end thereof slightly unwound from the casing and then the casing lid is closed, whereby the printing tape can be easily and suitably set in the tape cartridge.

Preferably, the tape printing apparatus includes a first urging lever arranged in the tape cartridge, for urging the feed driven roller toward the feed drive roller, and a first urging member arranged in the apparatus body, for being brought into contact with the first urging lever when the tape cartridge is loaded in the apparatus body to thereby urge the feed driven roller toward the feed drive roller by way of the first urging lever.

According to this preferred embodiment, when the tape cartridge is loaded in the apparatus body, the feed driven roller in rolling contact with the feed drive roller is pressed against the feed drive roller by the first urging lever. That is, the printing tape is pressed between the feed driven roller and the feed drive roller with a predetermined force for feeding the tape by rotation the rollers. This makes it possible to stabilize the feed of the printing tape.

More preferably, the tape printing apparatus includes a feed driven roller support shaft rotatably mounted in the tape cartridge and having the feed driven roller fitted thereon, and the first urging lever has one end engaging with the feed driven roller support shaft, another end with which the first urging member is brought into contact, and an intermediate portion at a location closer to the one end than the another end, the first urging lever being mounted in the tape cartridge via the intermediate portion in a manner swingable thereabout.

According to this preferred embodiment, the first urging lever is swingable or capable of performing seesaw motion about the intermediate portion and hence the feed driven roller is pressed by the first urging member by the mechanism of the lever and fulcrum, whereby the first urging lever exerts a large urging force by utilizing a small force applied thereto by the first urging member. Particularly, when the first urging member is a spring, a large urging force can be obtained by a spring having a small spring constant, whereby it is possible to apply a stable urging force to the feed driven roller.

Preferably, the tape cartridge further contains a roll of laminating tape, the tape printing apparatus further including a laminating tape-affixing device for affixing the laminating tape to a printed portion of the printing tape while feeding the laminating tape by unwinding the roll of the laminating tape, in synchronism with printing operation of the printing device, the laminating tape-affixing device comprising a laminating drive roller arranged in the apparatus body, and a laminating driven roller arranged in the tape cartridge, the laminating drive roller and the laminating driven roller affixing the laminating tape to the printing tape by feeding the laminating tape and the printing tape placed one upon another therebetween by rotation thereof, in the state of the tape cartridge being loaded in the apparatus body.

According to this preferred embodiment, not only the feed driven roller but also the laminating driven roller is arranged in the tape cartridge which is removably loaded in the apparatus body, so that when the tape cartridge is loaded in the body, the laminating driven roller rolls on the laminating drive roller, whereas when the tape cartridge is removed from the body, the laminating driven roller is detached from the laminating drive roller. Therefore, it is possible to omit a dedicated mechanism for moving the laminating driven roller. Further, the laminating driven roller may be designed to have a width corresponding to the width of a roll of laminating tape (and a roll of printing tape) set in the tape cartridge, to exert the appropriate urging force to the laminating drive roller.

More preferably, the laminating driven roller has an outer peripheral surface formed of a hard material.

According to this preferred embodiment, it is possible to construct the laminating driven roller at reduced manufacturing costs, thereby reducing the manufacturing costs of the tape cartridge in which the laminating driven roller is arranged.

Further preferably, the tape printing apparatus further includes a second urging lever arranged in the tape cartridge, for urging the laminating driven roller toward the laminating drive roller, and a second urging member arranged in the apparatus, for being brought into contact with the second urging lever when the tape cartridge is loaded in the apparatus body to thereby urge the laminating driven roller toward the laminating drive roller by way of the second urging lever.

According to this preferred embodiment, when the tape cartridge is loaded in the apparatus body, the laminating driven roller in rolling contact with the laminating drive roller is pressed against the laminating drive roller by way of the second urging lever. That is, the laminating tape and the printing tape are pressed between the laminating driven roller and the laminating drive roller with a predetermined force for feeding the laminating tape and the printing tape by rotation of the rollers. This makes it possible to stabilize the affixation and feeding of the laminating tape and the printing tape.

Still more preferably, the tape printing apparatus includes a laminating driven roller support shaft rotatably mounted in the tape cartridge and having the laminating driven roller fitted thereon, and the second urging lever has one end engaging with the laminating driven roller support shaft, another end with which the second urging member is brought into contact, and an intermediate portion at a location closer to the one end of the second urging lever than the another end of the second urging lever, the second urging lever being mounted in the tape cartridge via the intermediate portion in a manner swingable thereabout.

According to this preferred embodiment, the second urging lever is swingable or capable of performing seesaw motion about the intermediate portion and hence the laminating driven roller is pressed by the second urging member by the mechanism of the lever and fulcrum, whereby the second urging level exerts a large urging force by utilizing a small force applied thereto by the second urging member. Particularly, when the second urging member is a spring, a large urging force can be obtained by a spring having a small spring constant, whereby it is possible to apply a stable urging force to the laminating driven roller.

Preferably, the tape cartridge includes a cartridge casing forming an outer shell of the tape cartridge, the cartridge casing comprising a casing body, and a casing lid attached to the casing body in a manner such that the casing body can be opened and closed, the roll of printing tape being radially mountable in and radially removable from the casing body, in a state of the casing lid being opened.

According to this tape cartridge, the user can open the casing lid and replace only the printing tape through the opened lid to thereby contribute to conservation of resources. Further, the printing tape is radially mounted in and radially removed from the apparatus body, so that when the tape is replaced, loosening of the tape hardly develops and at the same time the tape per se becomes easy to deal with.

Preferably, the tape printing apparatus includes a tape shaft for supporting the roll of printing tape thereon, a tape shaft holder for supporting the tape shaft, and a tape guide for controlling a lateral position of the printing tape being fed, at least one of the printing tape in relation to the tape shaft and the tape shaft in relation to the tape shaft holder being permitted to perform a slight axial movement.

According to this tape printing apparatus, it is possible to feed the printing tape with accuracy with respect to the lateral position thereof, which enables printing to be carried out on a desired position of the front surface of the printing tape.

More preferably, the tape printing apparatus further includes a cutting device for cutting off a printed portion of the printing tape.

According to this preferred embodiment, it is possible to form a laminated label.

Preferably, the tape printing apparatus includes a printing tape shaft for supporting the roll of printing tape thereon, a laminating tape shaft for supporting a roll of laminating tape to be affixed to an unwound portion of the printing tape thereon, laminating rollers for feeding the printing tape and the laminating tape while pressing the printing tape and the laminating tape between the laminating rollers, a printing tape guide for controlling a lateral position of the printing tape being fed, and a laminating tape guide for controlling a lateral position of the laminating tape being fed, the printing tape being permitted to perform a slight axial movement with respect to the printing tape shaft, and at the same time the laminating tape being permitted to perform a slight axial movement with respect to the laminating tape shaft.

According to this tape printing apparatus, the printing tape and the laminating tape can be accurately fed with respect to the lateral position thereof, which makes it possible to perform printing on a desired position of the front surface of the printing tape as well as laminate the laminating tape to the printed portion of the tape with accuracy.

More preferably, the tape printing apparatus further includes a cutting device for cutting off a printed portion of the printing tape.

According to this preferred embodiment, it is possible to form a laminated label.

More preferably, the roll of printing tape comprises a tape core supported on the printing tape shaft, and a printing tape body wound around the tape core, and a range of the slight axial movement of the printing tape being limited to an axial clearance between the printing tape shaft and the tape core.

According to this preferred embodiment, the range of the slight axial movement of the printing tape is limited to the axial clearance between the printing tape shaft and the tape core and hence the printing tape shaft and the roll of printing tape are kept from contact with each other, whereby it is possible to prevent the above range from being unfavorably limited by the deviated turns of the printing tape wound around the tape core.

Further preferably, the printing tape shaft comprises a shaft for having the roll of printing tape fitted thereon, a flange for limiting the slight axial movement of the roll of printing tape fitted on the shaft, and a retaining hook formed on a periphery of the shaft, and the axial clearance between the printing tape shaft and the tape core is defined by a distance between one end face of the tape core and an inner surface of the flange opposed to the one end face of the tape core.

More preferably, the roll of the laminating tape comprises a tape core supported on the laminating tape shaft, and a laminating tape body wound around the tape core, and a range of the slight axial movement of the laminating tape being limited to an axial clearance between the laminating tape shaft and the tape core.

According to this preferred embodiment, the range of the slight axial movement of the laminating tape is limited to the axial clearance between the laminating tape shaft and the core and hence the laminating tape shaft and the laminating tape are kept from contact with each other, whereby it is possible to prevent the above range from being unfavorably limited by improper turns of the laminating tape wound around the tape core.

More preferably, the laminating tape shaft comprises a shaft for having the roll of laminating tape fitted thereon, a flange for limiting the slight axial movement of the laminating tape fitted on the shaft, and a retaining hook formed on a periphery of the shaft, and the axial clearance between the laminating tape shaft and the tape core is defined by a distance between one end face of the tape core and an inner surface of the flange opposed to the one end face of the tape core.

To attain the second object, according to a second aspect of the invention, there is provided a tape cartridge for use with a tape printing apparatus incorporating a feed drive roller for feeding the tape, the tape cartridge containing a tape and being removably loaded in the tape printing apparatus, the tape cartridge comprising:

a cartridge casing;

a feed driven roller arranged in the cartridge casing, for being brought into rolling contact with the feed drive roller to thereby press the tape between the feed driven roller and the feed driven roller to feed the tape by rotation of the feed driven roll and the feed drive roller performed cooperatively, in a state of the tape cartridge being loaded in the apparatus; and first urging means arranged in the cartridge casing, for urging the feed driven roller toward the feed drive roller.

According to this tape cartridge, in addition to the feed driven roller, the first urging means for urging the feed driven roller toward the feed drive roller is arranged in the cartridge casing. Hence, it is possible to select and mount first urging means in the cartridge casing in a manner adapted to the tape width and material of a printing tape contained in the cartridge casing, such that the urging force (sandwiching force) of the feed driven roller in cooperation with the feed drive roller becomes optimum for feeding the tape.

More preferably, the tape cartridge includes a feed driven roller support shaft rotatably supported on the cartridge casing and having the feed driven roller arranged thereon, the first urging means including a first urging lever having one end engaging with the feed driven roller support shaft, another end, an intermediate portion at a location closer to the one end than the another end, the first urging lever being mounted in the tape cartridge via the intermediate portion in a manner swingable thereabout, and a first spring provided at the another end of the first urging lever.

According to this preferred embodiment, the feed driven roller is urged by way of the first urging lever by the first spring. Since the first urging lever is swingable or capable of performing seesaw motion about the intermediate portion thereof, the feed driven roller is pressed by the first spring by the mechanism of the lever and fulcrum, whereby the first lever exerts a large urging force by utilizing a small force applied thereto by the first spring having a small spring constant. Therefore, it is possible to apply a stable urging force to the feed driven roller.

Further preferably, the cartridge casing has a tape-holding block for holding the tape therein, the first urging lever extending longitudinally along a longitudinal side of the printing tape-holding block.

According to this preferred embodiment, the first urging lever can have the maximum length to thereby apply a more stable urging force to the feed driven roller.

Further preferably, the feed driven roller is supported on the cartridge casing at the intermediate portion thereof in a manner swingable about the intermediate portion between a withdrawn position to which the feed driven roller is withdrawn when the feed driven roller is brought into rolling contact with the feed drive roller upon loading of the tape cartridge into the tape printing apparatus and an advanced position to which the feed driven roller advances when the feed driven roller is detached from the feed drive roller upon removal of the tape cartridge from the tape printing apparatus body, the tape cartridge including a tape shaft on which the tape is fitted as a roll and which rotates in unison with the tape, the tape shaft having at least one engaging portion for inhibiting rotation of the roll on the tape shaft, and the first urging lever having a rotation-inhibiting portion for being brought into engagement with the at least one engaging portion when the feed driven roller advances to the advanced position, and being disengaged from the at least one engaging portion when the feed driven roller is withdrawn to the withdrawn position.

According to this preferred embodiment, when the tape cartridge is loaded in the tape printing apparatus, the rotation-inhibiting portion of the first urging lever is disengaged from the at least one engaging portion of the tape shaft, whereby the tape cartridge is made ready for unwinding the printing tape, whereas when the tape cartridge is removed from the apparatus, the rotation-inhibiting portion of the first urging lever is brought into engagement with the at Least one engaging portion of the tape shaft to thereby prevent the rotation of the tape shaft. As a result, the leading end (unwound portion) of the printing tape can be prevented from being retracted into the cartridge casing during transport or storage of the tape cartridge.

Preferably, the feed driven roller is supported on the cartridge casing at the intermediate portion thereof in a manner swingable about the intermediate portion between a withdrawn position to which the feed driven roller is withdrawn when the feed driven roller is brought into rolling contact with the feed drive roller upon loading of the tape cartridge into the tape printing apparatus and an advanced position to which the feed driven roller advances when the feed driven roller is detached from the feed drive roller upon removal of the tape cartridge from the tape printing apparatus, the feed driven roller pressing an unwound portion of the printing tape between the feed driven roller and the cartridge casing when the feed driven roller is in the advanced position, and releasing the unwound portion when the feed driven roller is brought to the withdrawn position.

According to this preferred embodiment, when the tape cartridge is loaded in the tape printing apparatus, the feed driven roller moves to the withdrawn position to release the leading end (unwound portion) of the printing tape sandwiched between the feed driven roller and the cartridge casing, whereby the tape cartridge is made ready for unwinding the roll of printing tape, whereas when the tape cartridge is removed from the apparatus, the feed driven roller moves to the advanced position to firmly hold the leading end (unwound portion) of the printing tape. Therefore, the leading end of the printing tape can be prevented from being retracted into the cartridge casing during transport or storage of the tape cartridge.

Preferably, the tape cartridge according further contains a laminating tape to be affixed to the printing tape together with the printing tape, the apparatus having a laminating drive roller arranged therein for feeding the laminating tape, the tape cartridge further comprising a laminating driven roller arranged in the cartridge casing, for being brought into rolling contact with the laminating drive roller to thereby press the laminating tape between the laminating driven roller and the laminating drive roller to feed the laminating tape by rotation of the laminating driven roller and the laminating drive roller performed cooperatively, in a state of the tape cartridge being loaded in the tape printing apparatus, and second urging means arranged in the cartridge casing, for urging the laminating driven roller toward the laminating drive roller.

According to this tape cartridge, in addition to the laminating driven roller, the second urging means for urging the laminating driven roller toward the laminating drive roller is arranged in the cartridge casing. Hence, it is possible to select and mount second urging means in the cartridge casing in a manner adapted to the tape width and material of the laminating tape contained in the cartridge casing, such that the urging force (sandwiching force) of the laminating driven roller in cooperation with the laminating drive roller becomes optimum for feeding the tape.

Further preferably, the tape cartridge includes a laminating driven roller support shaft rotatably supported on the cartridge casing and having the laminating driven roller arranged thereon, the second urging means including a second urging lever having one end engaging with the laminating driven roller support shaft, another end, and an intermediate portion at a location closer to the one end of the second urging lever than the another end of the second urging lever, the second urging lever being mounted in the tape cartridge via the intermediate portion in a manner swingable thereabout, and a second spring provided on the another end of the second urging lever.

According to this preferred embodiment, the laminating driven roller is urged by way of the second urging lever by the second spring. Since the second urging lever is swingable or capable of performing seesaw motion about the intermediate portion thereof, the laminating driven roller is pressed by the second spring by the mechanism of the lever and fulcrum, whereby the second urging lever exerts a large urging force by utilizing a small force applied thereto by the second spring. Therefore, it is possible to apply a stable urging force to the laminating driven roller.

Still more preferably, the cartridge casing has a laminating tape-holding block for holding the laminating tape therein, the second urging lever extending longitudinally along a longitudinal side of the laminating tape-holding block.

According to this preferred embodiment, the second urging lever can have the maximum length for applying a more stable urging force to the laminating driven roller.

More preferably, the tape cartridge includes a laminating tape shaft supported on the cartridge casing, for rotation with the laminating tape, and a brake spring in the form of a coil tightly wound around the laminating tape shaft, the brake spring having one end thereof fixed to the cartridge casing.

According to this preferred embodiment, the brake spring is tightly wound around the laminating tape shaft into a coil in a manner surrounding the shaft to brake the rotation thereof, which prevents loosening of the laminating tape, whereby the laminating tape can be prevented from adhering to an inner surface of the cartridge casing. Moreover, the spring forces of the brake spring for braking the laminating tape shaft act toward the axis of the shaft to be canceled by each other, thereby preventing the application of a useless force to the laminating tape shaft. This makes it possible to feed the laminating tape without impairing the smoothness of the feed thereof.

To attain the second object, according to a third aspect of the invention, there is provided a tape cartridge for being removably loaded in a tape printing apparatus that prints on a tape by an ink jet printing method, the tape printing apparatus including a feed drive roller for feeding a tape, the tape cartridge comprising:

a cartridge casing forming an outer shell of the tape cartridge, the cartridge casing comprising:

a casing body, and a casing lid attached to the casing body in a manner such that the casing body can be opened and closed; and a feed driven roller mounted in the casing lid, for being brought into rolling contact with the feed drive roller to thereby press the tape between the feed driven roller and the feed drive roller to feed the tape by rotation of the feed driven roller and the feed drive roller performed cooperatively, in a state of the tape cartridge being loaded in the apparatus;

the tape being in the form of a roll, and radially mountable in and radially removable from the casing body, in a state of the casing lid being opened.

According to this tape cartridge, the user can open the casing lid and replace only the printing tape through the opened lid to thereby contribute to conservation of resources. Further, the printing tape is radially mounted in and radially removed from the apparatus body, so that when the tape is replaced, loosening of the tape hardly develops and at the same time the tape per se becomes easy to deal with. Furthermore, the printing tape is placed in the casing with a leading end thereof slightly unwound and then the casing lid is closed, whereby the tape can be suitably set in the cartridge casing. That is, the replacement of the tape can be performed with ease.

Preferably, the tape cartridge includes a feed driven roller support shaft rotatably mounted in the casing lid and having the feed driven roller arranged thereon, and an urging member arranged in the casing body for engagement with the feed driven roller support shaft to urge the feed driven roller toward the feed drive roller by way of the feed driven roller support shaft, the casing body having an opening for operation, the urging member being operable through the opening, for engagement with or disengagement from the feed driven roller support shaft.

If the feed driven roller is mounted in the casing lid and the urging member for engagement with the feed driven roller is mounted in the casing body, there is a fear that the urging member is caught in the feed driven roller, thereby preventing the opening of the casing lid when the casing lid is desired to be opened. According to this preferred embodiment, the urging member can be engaged with and disengaged from the feed driven roller support shaft by operating from the outside of the casing body, which ensures that the casing lid is opened and closed without any inconveniences, although the urging member is mounted in the casing body.

To attain the second object, according to a fourth aspect of the invention, there is provided a tape printing apparatus for use with a tape cartridge that holds a roll of a tape and is removably mounted in the apparatus, the tape printing apparatus operating to print on the tape by unwinding the tape from the tape cartridge, the tape printing apparatus comprising a feed drive roller for feeding the tape, the tape cartridge comprising:

a cartridge casing;

a feed driven roller arranged in the cartridge casing, for being brought into rolling contact with the feed drive roller to thereby press the tape between the feed driven roller and the feed drive roller to feed the tape by rotation of the feed driven roller and the feed drive roller performed cooperatively, in a state of the tape cartridge being loaded in the tape printing apparatus; and first urging means arranged in the cartridge casing, for urging sad feed driven roller toward the feed drive roller.

According to the above tape printing apparatuses, it is possible to feed the printing tape in a more stable manner for carrying out favorable printing on the tape.

To attain the second object, according to a fifth aspect of the invention, there is provided a tape cartridge for use with a tape printing apparatus incorporating a feed drive roller for feeding a tape, the tape cartridge containing the tape and being removably loaded in the tape printing apparatus, the tape cartridge comprising:

a cartridge casing;

a feed driven roller arranged in the cartridge casing, for being brought into rolling contact with the feed drive roller to thereby press the tape between the feed driven roller and the feed driven roller to feed the tape by rotation of the feed driver roller and the feed drive roller performed cooperatively, in a state of the tape cartridge being loaded in the tape printing apparatus; and an urging device arranged in the cartridge casing, for urging the feed driven roller toward the feed drive roller.

According to this tape printing apparatus, it is possible to obtain the same effects as obtained by the second aspect of the invention.

The above and other objects, features, and advantages of the invention will become more apparent from the following detailed description taken in conjunction with the accompanying drawings.

DETAILED DESCRIPTION

The invention will now be described in detail with reference to the drawings showing a tape cartridge, and a tape printing apparatus using the tape cartridge, according to an embodiment thereof. The tape printing apparatus is an ink jet type that carries out color printing of desired characters and the like entered via a keyboard thereof on a printing tape by an ink jet printing method and cutting off the printed portion of the printing tape to thereby form a label. Further, this tape printing apparatus carries not only a printing tape but also a laminating tape thereon, whereby it is also possible to laminate the laminating tape to the printed portion of the printing tape and cut off the printing tape laminated with the laminating tape to thereby form a laminated label. The printing tape and the laminating tape are provided in a state contained in a tape cartridge.

Figure 1:
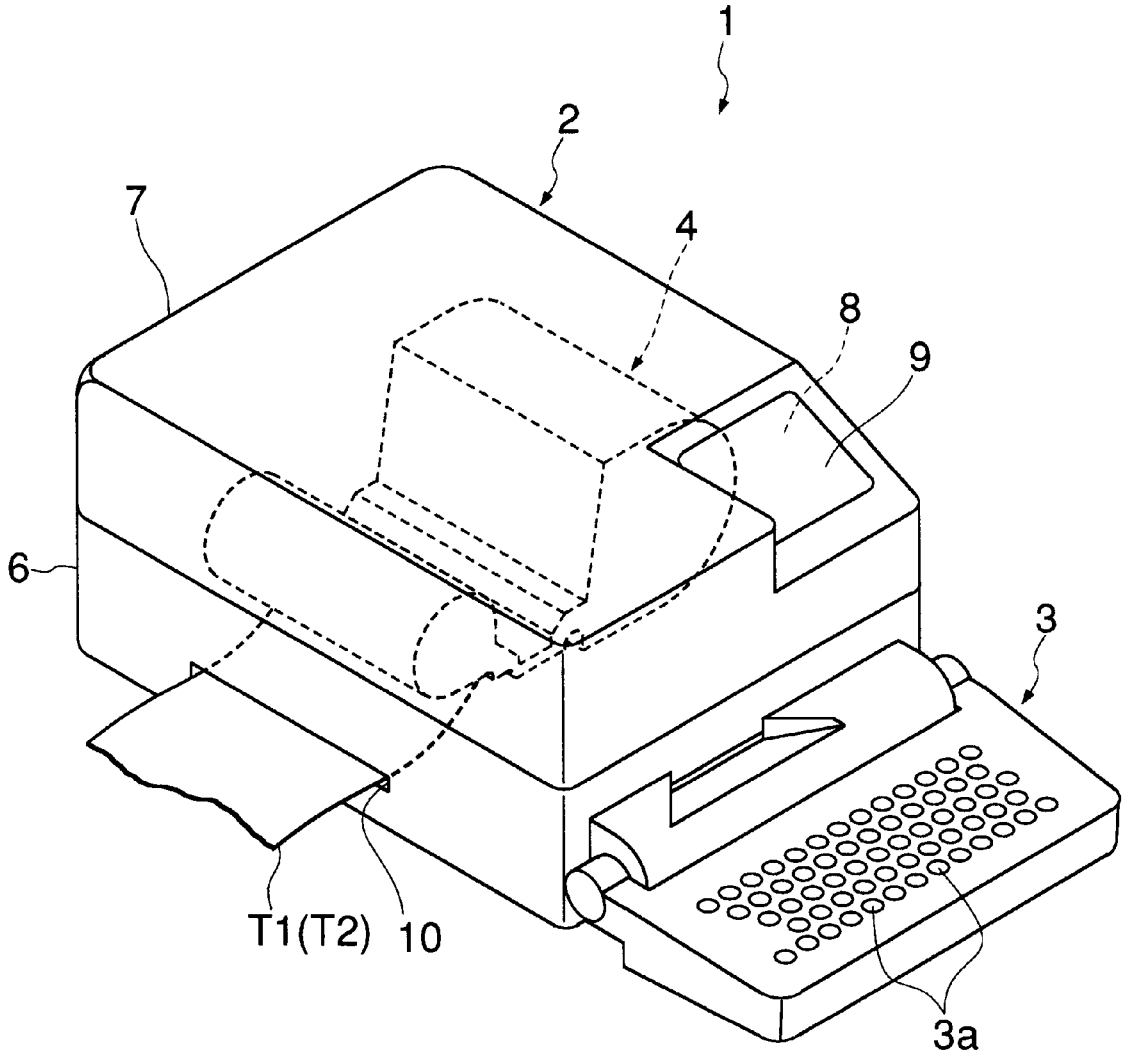
FIG. 1 is a perspective view of an appearance of a tape printing apparatus according to an embodiment of the invention.
Figure 2:
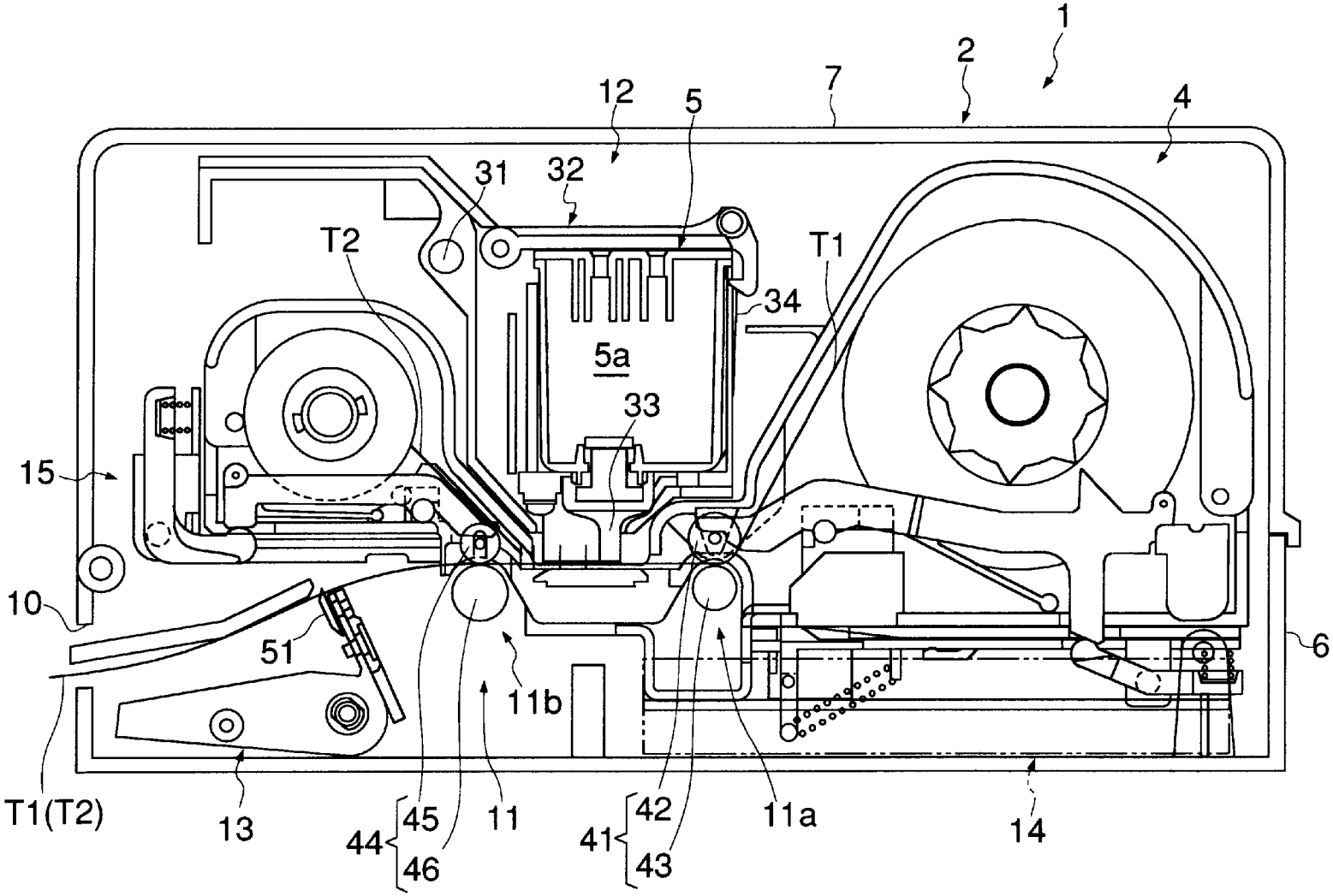
FIG. 2 is a cross-sectional view of a body of the tape printing apparatus according to the embodiment.

FIG. 1 is a perspective view of an appearance of the tape printing apparatus, and FIG. 2 is a cross-sectional view of the tape printing apparatus. As shown in the figures, the tape printing apparatus 1 is comprised of an apparatus body 2, a keyboard 3 mounted on a front-side portion of the apparatus body 2, a tape cartridge 4 containing a roll of printing tape T1 and a roll of laminating tape T2, and an ink cartridge 5 containing ink of four colors. The tape cartridge 4 and the ink cartridge 5 are loaded in the apparatus body 2.

On the top of the keyboard 3 are arranged various kinds of keys 3*a* which form means of entering data into the tape printing apparatus 1. In this embodiment, the keyboard 3 is attached to the apparatus body 2 such that the keyboard 3 can be selectively brought to a vertical position or to a horizontal position. When the apparatus is used for printing, the keyboard 3 is brought to the horizontal position, whereas when the same is carried by the user, the keyboard 3 is brought to the vertical or folded position.

The apparatus body 2 has an apparatus casing 6 upper part of which is formed by a lid 7 which can be opened and closed for inserting and removing (i.e. loading and unloading) the tape cartridge 4 and the ink cartridge 5. In a right-side front portion of the lid 7 is formed a small window 9 in a manner corresponding in position, when the lid 7 is closed, to a liquid crystal display block 8 incorporated in the apparatus body 2. In a side wall of the apparatus casing 6 is formed a tape exit 10 in the form of a slit through which the laminated printing tape T1 is sent out of the apparatus.

Inside the apparatus casing 6 there are arranged a tape feeder 11 for feeding the printing tape T1 and the laminating tape T2 and at the same time attaching the laminating tape T2 to the printing tape T1, a printing device 12 for applying color printing on the printing tape T1 by an ink jet printing method, a cutting device 13 for cutting off a portion of the printing tape T1 laminated with the laminating tape T2, and a circuit board 14 for controlling operations of these devices and carrying out information processing. Further, the apparatus casing 6 also contains an latching mechanism 15 for securing the tape cartridge 4 in a position where the above devices can gain access thereto and releasing the same for removal (see FIG. 2).

The tape feeder 11, the printing device 12 and the cutting device 13 are controlled by a control circuit incorporated in the circuit board 14 such that they operate in a manner interlocked with each other. More specifically, when the tape feeder 11 is driven, the printing tape T1 is unwound from the tape cartridge 4 and printed based on key entries made via the keyboard 3 by the printing device 12. The printing device 12 is arranged such that it faces an intermediate portion of the tape cartridge 4 from above, for accessing to an unwound portion of printing tape T1. During the printing operation, the printing tape T1 is fed forward, and at the same time the laminating tape T2 is unwound from the tape cartridge 4 to be continuously affixed to the printed portion of the printing tape T1. The printing portion of the printing tape T1 with the laminating tape T2 affixed thereto is sent out of the tape exit 10 by the tape feeder 11. When the trailing edge of the printed portion with a trailing marginal area allowed therefor reaches the position of the cutter, the tape feeder 11 is stopped to allow the cutting device 13 to cut the printing tape T1 (and the laminating tape T2). Thus a laminated label with desired characters and the like printed thereon is formed.

The printing device 12 includes a carriage guide shaft 31 having opposite lateral ends (front and rear ends if shown in FIG. 1) thereof supported on a frame, not shown, a carriage 32 slidably attached to the carriage guide shaft 31, a timing belt, not shown, which is driven in a forward or reverse direction to move the carriage 32 in the direction of the width of the printing tape T1 in a reciprocating manner, and a carriage motor, not shown, for driving the timing belt in a forward or reverse direction. On the carriage 32 are integrally mounted a print head 33 at a lower portion thereof, and a cartridge holder 34 at an upper portion of the same, for holding the ink cartridge 5 therein. In this case, the print head 33 is mounted on the carriage 32 in a manner facing downward, and the ink cartridge 5 is also held in the cartridge holder 34 in a manner facing downward. When the ink cartridge 5 is loaded in the cartridge holder 34, ink from is allowed to flow from four ink tanks 5*a* to the print head 33. The ink tanks 5*a* are filled with yellow ink, cyan ink, magenta ink and black ink, respectively.

The tape feeder 11 has a printing tape feed mechanism 11*a* and a laminating tape feed mechanism 11*b* arranged on opposite sides of the printing device 12 in the direction of feeding of the printing tape T1. The printing tape feed mechanism 11*a* includes a pair of feed rollers 41 comprised of a feed driven roller 42 at an upper position and a feed drive roller 3 at a lower position and a feed motor, not shown, for rotating the feed drive roller 43. The feed drive roller 43 is arranged in the apparatus body 2, while the feed driven roller 42 is arranged in the tape cartridge 4. When the tape cartridge 4 is loaded in the apparatus body 2, the feed driven roller 42 presses the printing tape T1 against the feed drive roller 43. By rotating the feed motor, the printing tape T1 pressed between the feed driven roller 42 and the feed drive roller 43 is fed forward. It should be noted that the feed of the printing tape T1 and the reciprocation of the print head 33 corresponds to the relationship between the main scanning direction and the sub scanning direction in printing technology. Therefore, the feed motor and the carriage motor operate in a manner interlocked with each other.

The laminating tape feed mechanism 11*b* includes a pair of laminating rollers 44 comprised of a laminating driven roller 45 at an upper position and a laminating drive roller 46 at a lower position and a laminating motor, not shown, for rotating the laminating drive roller 46. The laminating motor and the above-mentioned feed motor are implemented by an identical or single motor, and the torque or turning force from this motor is transmitted by a reduction gear train, not shown, in a manner bifurcated to the feed rollers 41 and the laminating rollers 44, respectively. The laminating drive roller 46 is arranged in the apparatus body 2, while the laminating driven roller 45 is arranged in the tape cartridge 4. When the tape cartridge 4 is loaded in the apparatus body 2, the printing tape T1 and the laminating tape T2 are pressed between the laminating driven roller 45 and the laminating drive roller 46. In this state, the laminating motor rotates to attach the laminating tape T2 to the printing tape T1 using the pressure between the laminating driven roller 45 and the laminating drive roller 46 while sending forward the resulting laminated tape.

In this case, it is preferred that the laminating driven roller 45 is a metal or resin roller and the laminating drive roller 46 is a metal or resin roller having a rubber layer formed therearound. If the laminating driven roller 45 and the laminating drive roller 46 are constructed as above, the laminating tape T2 can be affixed to the printing tape T1 with a uniform pressure, resulting in uniform adhesion of the tapes, and at the same time it is possible to reduce the manufacturing cost of the laminating driven roller 45 as a component of a consumable article i.e. the tape cartridge 4. This results in the reduction of the manufacturing costs of the tape cartridge 4.

The feed rollers 41 and the laminating rollers 44 are arranged on the same horizontal plane so that the printing tape T1 can be moved horizontally between the feed rollers 41 and the laminating rollers 44. Further, the rollers 41 and 44 are configured such that the laminating rollers 44 rotate slightly faster than the feed rollers 41. This difference in rotational speed applies a stretching force to the printing tape T1 between the feed rollers 41 and the laminating rollers 44 thereby keeping it taut.

The cutting device 13 has a cutter 51 and a cutter motor, not shown, for driving the cutter 51 for cutting operations. After completion of the printing operation, when the feed motor (laminating motor) sends the printing tape T1 for incremental feed over a predetermined distance, both the feed motor and the laminating motor are stopped. At the same time, the cutter motor is driven to cut off the printing tape T1. The cutting operation of the cutter 51 may be instructed manually through operation of a key of the keyboard 3.

Now, the printing tape T1 and the laminating tape T2 accessed by the above-mentioned tape feeder 11, printing device 12 and cutting device 13 will be described in detail, and then the tape cartridge 4 for holding the printing tape T1 and the laminating tape T2 and further the latching mechanism 15 for properly setting the tape cartridge 4 in the apparatus body 2 will be described.

The printing tape (printing tape body) T1 is comprised of a substrate tape, a layer of an adhesive coated on the back of the substrate tape and a peel-off paper tape affixed to the adhesive layer. The substrate tape is formed of a material that absorbs ink efficiently, such as paper, paper having a coating, or a film having coating. The adhesive layer is provided for affixing a printing portion of printing tape to an object material, such as a file or the like, as a label, while the peel-off paper tape is provided for preventing dust or the like from adhering to the adhesive layer. The laminating tape (laminating tape body) T2 is comprised of a substrate tape and an adhesive layer coated on the back of the substrate tape. The substrate tape is formed of a transparent film having a thickness of approximately 16–18 $\mu$m.

The printing tape T1 and the laminating tape T2 to be laminated onto the printing tape T1 are configured to have an approximately identical width and affixed to each other in a state in which the sides of the two tapes T1 and T2 placed one upon the other are aligned. More specifically, the laminating tape T2 has a width slightly smaller (by approximately 0.3 mm) than the printing tape T1 such that slight lateral displacement of the laminating tape T2 can be accommodated when it is affixed to the printing tape T1. That is, the laminating tape T2 is inset from an edge of the printing tape T1 on each of the opposite sides by 0.15 mm in the direction of the width thereof. The inset distance is determined using the displacement distance calculated from errors in manufacturing the tapes and is taken into account to prevent the laminating tape T2 from extending beyond the printing tape T1 in the direction of the width thereof.

Further, a whole length of the printing tape T1 mounted on the tape cartridge 4 is made slightly shorter than that of the laminating tape T2 such that the printing tape T1 is used up before using up the laminating tape T2, which prevents the printing operation from being carried out on the printing tape T1 when there is not sufficient laminating tape to completely cover the printing tape. It is preferable to inform the user that the remaining length of the printing tape T1 is small immediately before the printing tape T1 runs out of the tape cartridge 4. For example, a through hole is formed (or a black filled portion may be formed) in the rear end of the printing tape T1 to enable an optical sensor or the like to trigger an alarm.

Tape cartridges are provided that contain various (approximately ten) kinds of printing tape T1 and laminating tape T2 with various tape widths of from 4.5 mm to 96 mm. Additionally, the tape cartridges 4 are classified into a type which contains both a printing tape T1 and a laminating tape T2 and another type which contains only a printing tape T1 (see FIGS. 3 and 9). Further, the tape cartridges 4 classified into these two major types each include three kinds of tape cartridges, such as "large", "medium" and "small", different in width. Of the ten kinds of printing tape T1 and laminating tape T2, several kinds of tapes having smaller widths are mounted in the "small" class of tape cartridge, several kinds of tapes having medium widths in the "medium" class, and several kinds of tapes with larger widths in the "large" class. It should be noted that there are provided still other printing tapes T1 different in material or having background colors other than white. Therefor, it is possible to use at least several tens of kinds of printing tape T1 and laminating tape T2 including ones to be adopted in the future.

Figure 3:
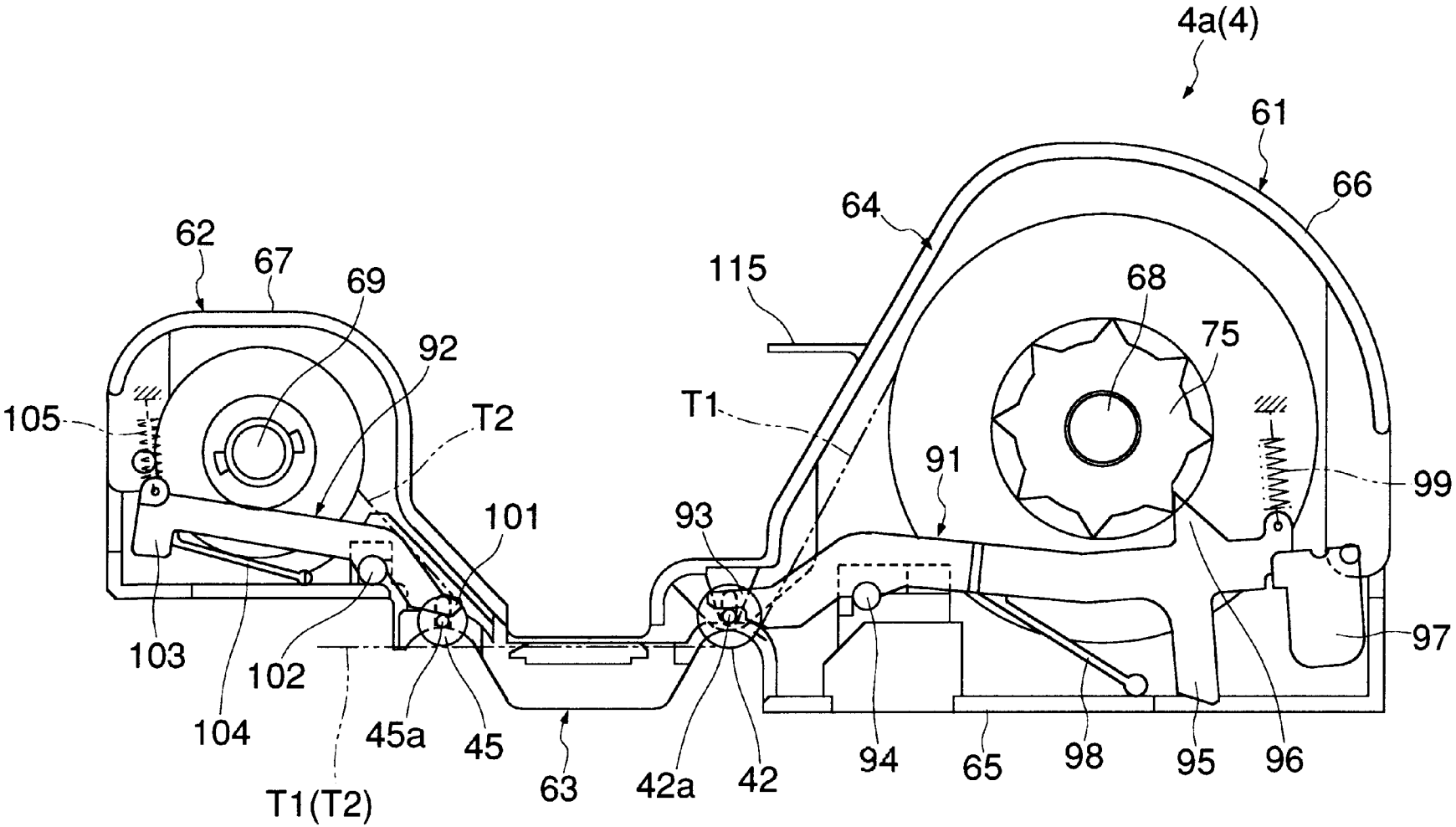
FIG. 3 is a side sectional view of a tape cartridge according to the embodiment.
Figure 4:
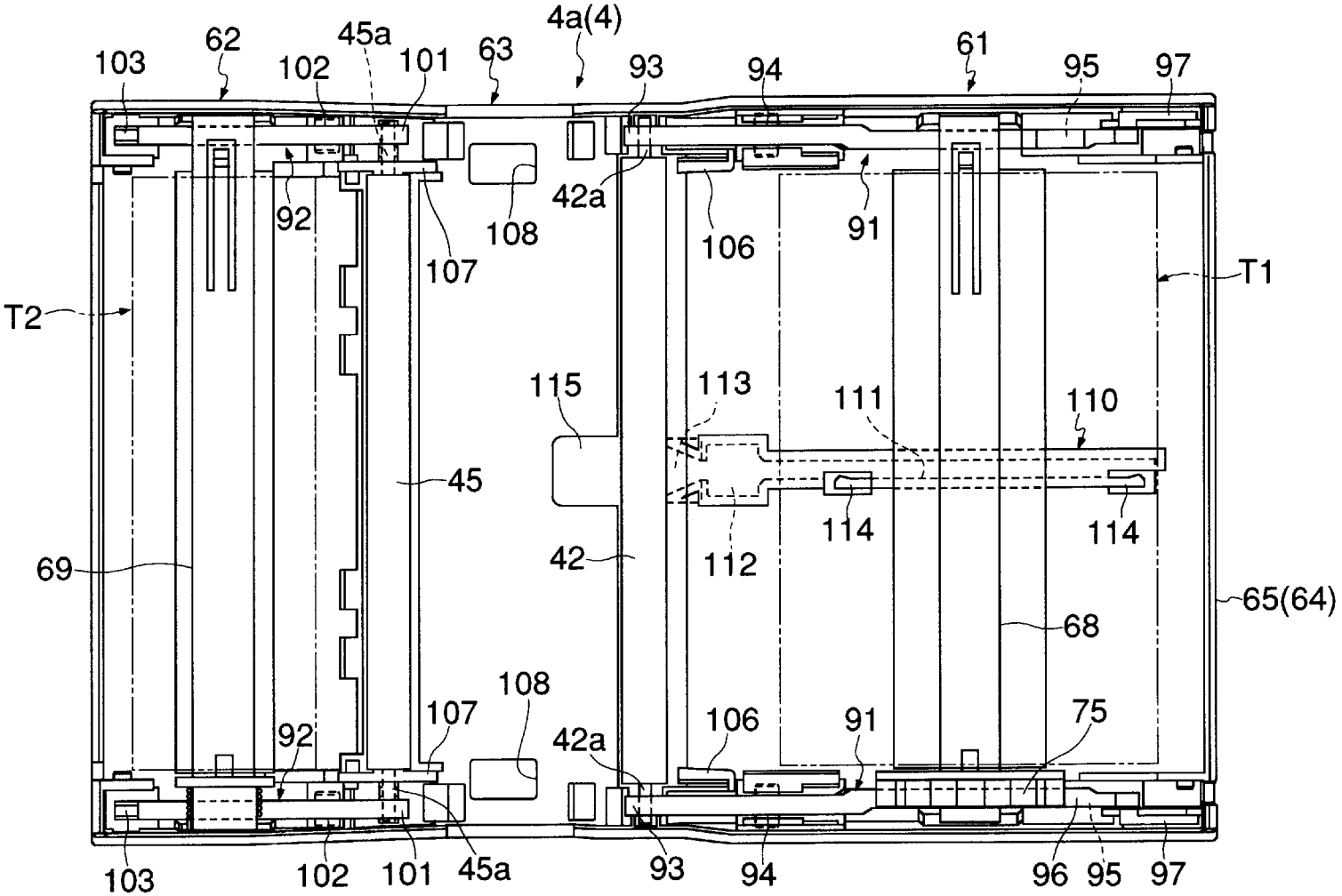
FIG. 4 is a plan sectional view of the tape cartridge according to the embodiment.

Next, the major two types of the tape cartridges 4 into which they are largely classified according to whether or not they contain a laminating tape will be described respectively by taking the above "large" type of tape cartridge having the maximum size as an example. A tape cartridge 4*a* shown in FIGS. 3 and 4 is of the type containing a printing tape T1 and a laminating tape T2, in which a main holding block 61 holding the printing tape T1 and an auxiliary holding block 62 holding the laminating tape T2 are connected by a connecting block at an intermediate location. The print head 33 of the printing device 12 faces the connecting block 63. A cartridge casing 64 housing these blocks is formed by a casing body 65, a main casing lid 66 on the main holding block-side, and an auxiliary casing lid 67 on the auxiliary holding block side. The cartridge casing 64 may be configured such that the user can open the main casing lid 66 and the auxiliary casing lid 67 to replace the printing tape T1 and the laminating tape T2 with new ones respectively. In such a case, to prevent the printing tape T1 and the laminating tape T2 from being erroneously mounted in the tape cartridge 4*a*, it is preferred that a tape shaft 68 used for the printing tape T1 and a laminating tape shaft 69 used for the laminating tape T2, both of which are described hereinafter, have different diameters.

Within the main holding block 61 the printing tape T1 is stored in the form of a roll and similarly within the auxiliary holding block 62 the laminating tape T2 is stored in the form of a roll. The printing tape T1 is fitted on the tape shaft 68 and this assembly is loaded into the cartridge casing 64 such that it may rotate within the casing. Similarly, the laminating tape T2 is fitted on the laminating tape shaft 69 and this assembly is loaded into the cartridge casing 64 such that it may rotate within the casing.

Figure 5B:
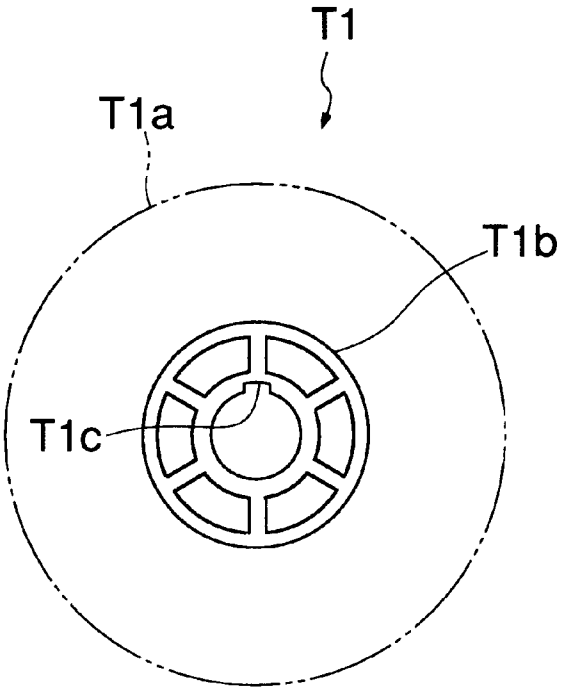
FIG. 5B is an end view of the roll of printing tape.
Figure 5A:
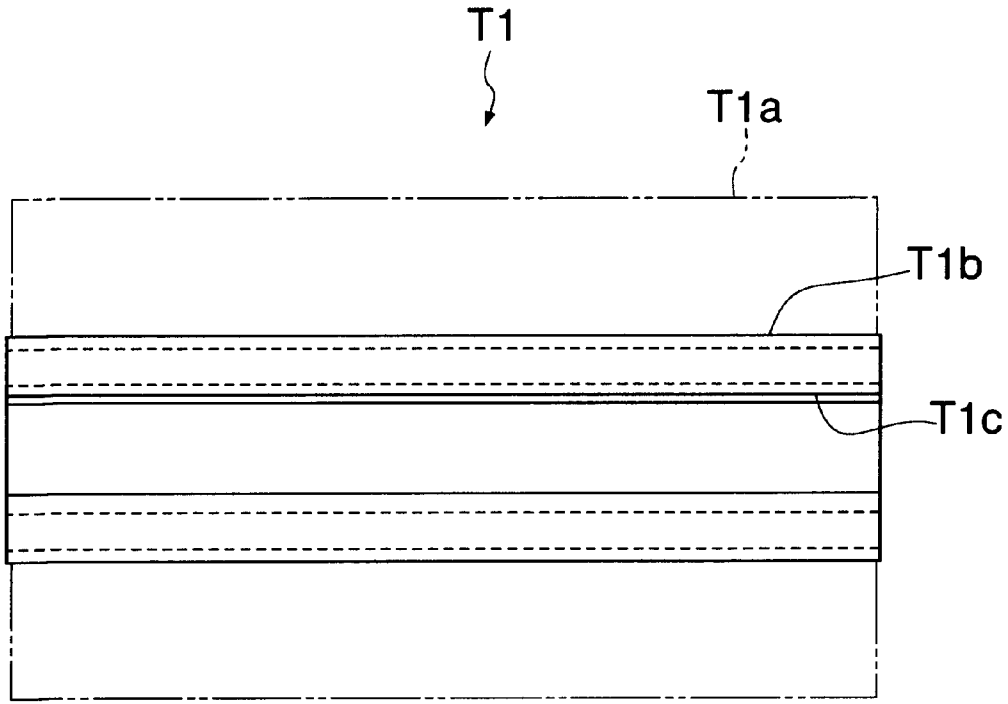
FIG. 5A is a side view of a roll of printing tape contained in the tape cartridge.

Referring to FIGS. 5A and 5B, the printing tape T1 is comprised of a tape T1*a* and a core T1*b* generally in the form of a hollow cylinder. The tape T1*a* is wound into a roll around the core T1*b*. The axial length of the core T1*b* is slightly larger than that of the tape T1*a*, i.e. the width of the printing tape T1, so as to prevent the tape T1*a* from being brought into contact with a flange 71, described hereinafter, of the tape shaft 68. Further, a key groove T1*c* is formed along an inner peripheral surface of the core T1*b*, for engagement with a key 74, described hereafter, of the tape shaft 68 when the printing tape T1 is mounted on the tape shaft 68.

Figure 6B:
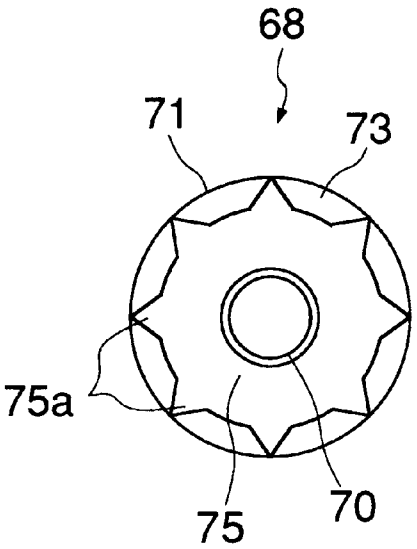
FIG. 6B is an end view of the tape shaft.
Figure 6A:
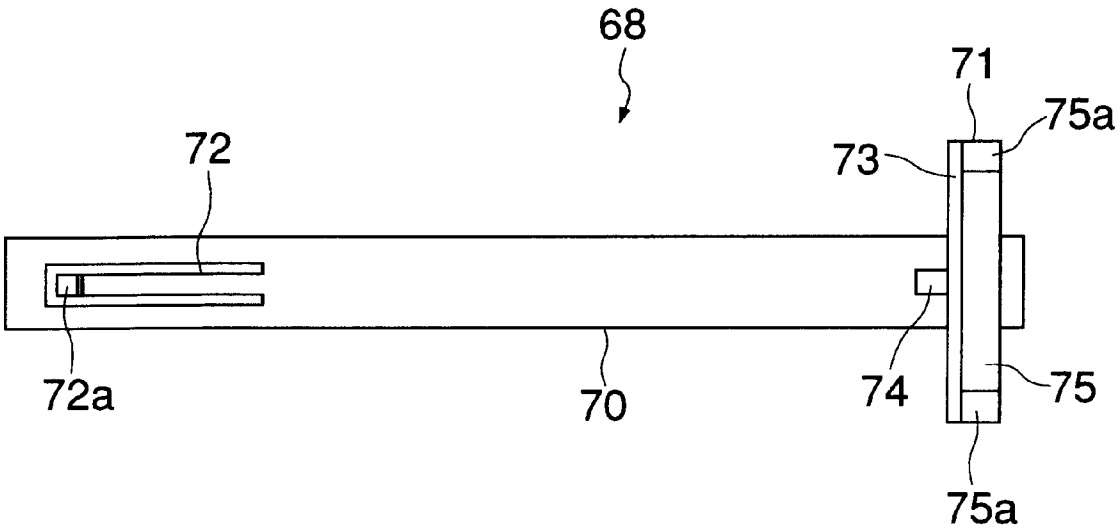
FIG. 6A is a side view of a tape shaft of the tape cartridge.

As shown in FIGS. 6A and 6B, the tape shaft 68 is comprised of a shaft body 70 on which the printing tape T1 is fitted, the flange 71 limiting the axial movement of the printing tape T1 fitted on the shaft body 70, and a retaining hook 72, all of which are integrally formed as a unitary member. The flange 71 is comprised of a disk 73, the key 74 extending from an axially inner end face of the disk 73, and a rotation control block 75 provided at an axially outer end face of the same. The key 74 extends from the disk 73 as a short ridge on the shaft body 70 for engagement with the key groove T1*c* of the printing tape T1 mounted on the shaft body 70 to thereby prevent the printing tape T1 from revolving on the shaft 68. The rotation control block 75 has a plurality of projections (engaging portions) 75*a* on an outer periphery thereof, which is generally in the form of a star. In the state of the tape cartridge 4*a* removed from the apparatus body 2, a rotation-inhibiting portion 96 of a feed urging lever 91, described hereinafter, is brought into engagement with the rotation control block 75, which prevents the rotation of the printing tape T1 during transport or storage of the tape cartridge 4*a*. Inversely, when the tape cartridge 4*a* is loaded in the apparatus body 2, the rotation-inhibiting portion 96 of the feed urging lever 91 is disengaged from the rotation control block 75, whereby it becomes possible to unwind the roll of printing tape T1.

The shaft body 70 is in the form of a pipe and has outer sides of the opposite ends thereof rotatably supported on opposed inner support portions of the cartridge casing 64. The retaining hook 72 is formed by cutting a portion of the shaft body 70 into a U shape elongated in the axial direction such that the hook 72 has resilient properties. The retaining hook 72 has a tip formed with a control projection 72*a* projecting i.e. spaced from an outer peripheral surface of the shaft body 70. The control projection 72*a* is in the form of an arrowhead with a sloped portion sloping down toward the distal end. When the printing tape T1 is inserted into the shaft body from an outer side end toward the flange 71, the core T1*b* of the printing tape T1 climbs on the control projection 72*a* and is further inserted in a manner pushing the control projection 72*a* onto the shaft body 70. When the printing tape T1 is inserted until it hits the flange 71, the control projection 72*a* comes out of the core T16 and is detached from an end of the core T1*b* to restore the state it was in before the core T1*b* climbs thereon.

That is, when the printing tape T1 is completely inserted onto the shaft body 70, the key groove T1*c* of the core T1*b* is engaged with the key 74 of the flange 71 and hence the rotation of the printing tape T1 about the tape shaft 68 is inhibited and further the core T1*b* is positioned between the flange 71 and the control projection 72*a*. Thus, the printing tape T1 is fitted on the tape shaft 68 in a state retained thereon. The axial length of the core T1*b* is made slightly smaller than the distance between the flange 71 and the control projection 72*a*, so that the printing tape T1 is mounted on the tape shaft 68 in a manner slightly movable in the axial direction with a predetermined clearance. This permits a portion of the printing tape T1 unwound from its roll to slightly move in a leftward or rightward direction (in an axial direction) as required according to width control and position control effected by the tape guide 106, described hereinbelow.

As described above, the printing tape T1 is configured to be able to slightly move in the axial direction of the tape shaft 68 as it is unwound from the tape cartridge 4*a* in accordance with the tape guide 106, and hence, even if the printing tape T1 has winding displacement or a lateral deviation of turns generated during the manufacturing process, for instance, it can be fed toward the feed rollers 41 in a state held in a suitable position in the direction of the width thereof. Therefore, undue strain is prevented from being applied to the printing tape T1 as it is unwound, which makes it possible to feed the same smoothly and with accuracy.

Figure 7B:
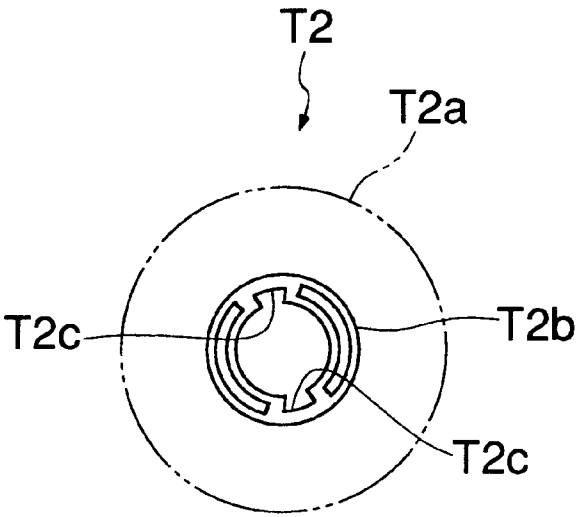
FIG. 7B is an end view of the roll of laminating tape.
Figure 7A:
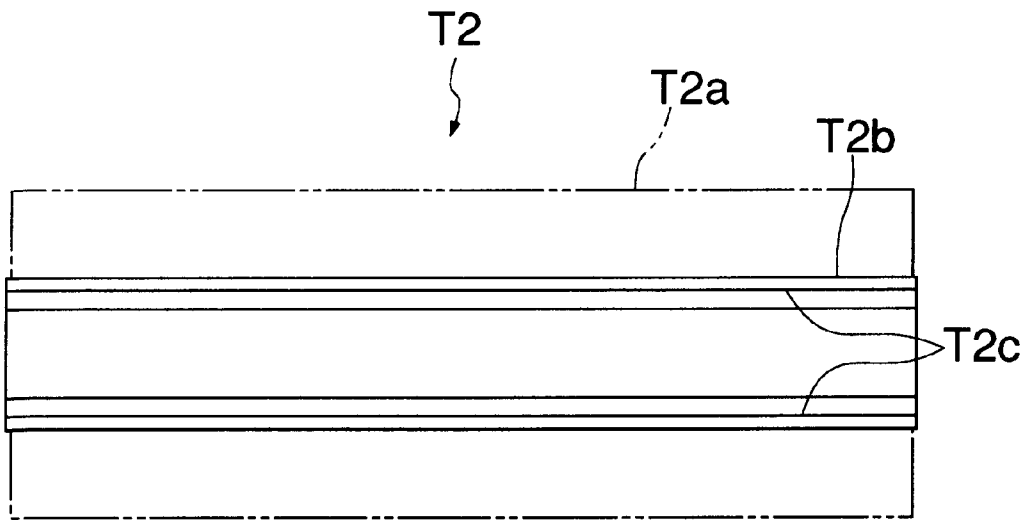
FIG. 7A is a side view of a roll of laminating tape contained in the tape cartridge.

Similarly to the printing tape T1, as shown in FIGS. 7A and 7B, the laminating tape T2 is formed of a tape T2*a* and a core T2*b* generally in the form of a hollow cylinder. The tape T2*a* is in the form of a roll wound around the core T2*b*. The axial length of the core T2*b* is slightly larger than that of the tape T2*a*, i.e. the width of the laminating tape T2, so as to prevent the tape T2*a* from being brought into contact with a flange 77, described hereinafter, of the laminating tape shaft 69. Further, along the inner peripheral surface of the core T2*b* there are formed a pair of key grooves T2*c* at diametrically opposite locations. The pair of key grooves T2*c* are engaged with a key 81, described hereafter, of the laminating tape shaft 69 when the laminating tape T2 is mounted on the laminating tape shaft 69.

Figure 8B:
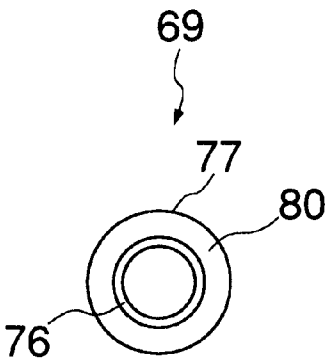
FIG. 8B is an end view of the laminating tape shaft.
Figure 8A:
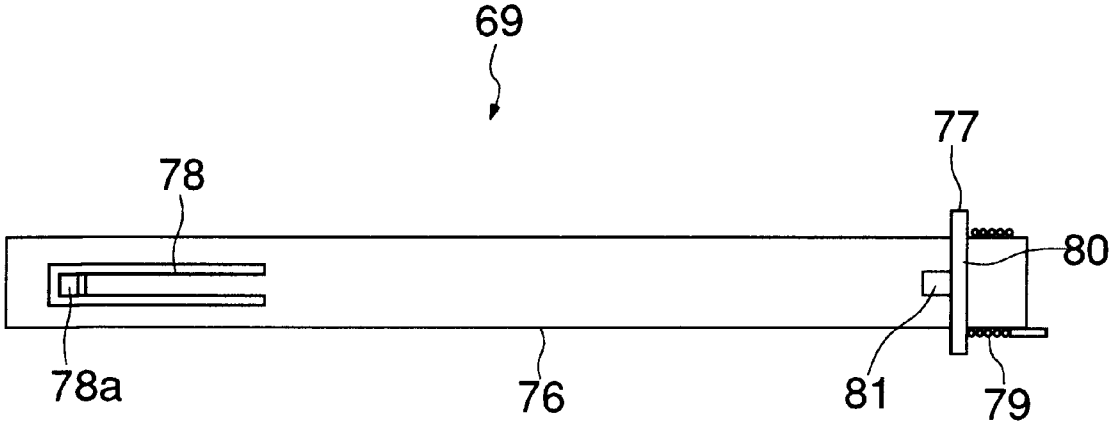
FIG. 8A is a side view of a laminating tape shaft of the tape cartridge.

As shown in FIGS. 8A and 8B, the laminating tape shaft 69 is comprised of a shaft body 76 on which the laminating tape T2 is fitted for rotation about its axis, the flange 77 limiting the axial movement of the laminating tape T2 fitted on the shaft body 76, and a retaining hook 78, all of which are integrally formed as a unitary member. A brake spring 79 is wound around the outer end portion on the flange side of the shaft body 76. The flange 77 is comprised of a disk 80, and the key 81 extending from an inner end face of the disk 80 in the axial direction of the laminating tape shaft. The key 81 extends from the disk 80 as a short ridge on the shaft body 76 for engagement with the key groove T2*c* of the laminating tape T2 fitted on the shaft body 76 to thereby prevent the laminating tape T2 from revolving on the shaft 69.

The shaft body 76 is in the form of a pipe and has outer sides of the opposite ends thereof rotatably supported on opposite inner portions of the cartridge casing 64. The retaining hook 78 is formed similarly to the above-mentioned retaining hook 72 of the tape shaft 68, by forming a cut in part of the shaft body 76, with a control projection 78*a* at a free end thereof. When the laminating tape T2 is fully inserted onto the shaft body 76, one of the key grooves T2*c* of the core T2*b* is engaged with the key 81 of the flange 77 to inhibit the rotation of the laminating tape T2 about the laminating tape shaft 69, and further the core T2*b* is positioned between the flange 77 and the control projection 78*a*. Thus, the laminating tape T2 is mounted on the laminating tape shaft 69 in a state retained thereon. In this case as well, the axial length of the core T2*b* is made slightly smaller than the distance between the flange 77 and the control projection 78*a*, so that the laminating tape T2 is mounted on the laminating tape shaft 69 with a predetermined clearance in a manner slightly movable in the axial direction.

In this case as well, similarly to the printing tape T1, the laminating tape T2 is configured to be able to slightly move in the axial direction as it is unwound from the tape cartridge 4*a* and hence, even if the laminating tape T2 has winding displacement i.e. a lateral deviation of turns generated during manufacturing process, it can be fed toward the laminating rollers 44 while maintaining a suitable lateral position thereof. Therefore, undue strain is not applied to the unwound portion of the laminating tape T2 as it is unwound, whereby it is possible to prevent wrinkles from being produced. Further, since the laminating tape T2 can be fed out smoothly and accurately, it is possible to affix the laminating tape T2 to the printing tape T1 with accuracy.

The brake spring 79 is in the form of a coil and tightly wound around the shaft body 76 in a manner embracing the same with a slight force, with one end thereof rigidly fixed to the shaft body 76. When the laminating tape T2 is unwound, the rotation of the laminating tape shaft 69 is braked by frictional force between the shaft body 76 and the brake spring 79, whereby when the laminating tape T2 is unwound, it is possible to affix the laminating tape T2 to the printing tape T1 in a tensioned state, whereas when the same is not unwound, the loosening thereof can be prevented. Particularly, according to this brake construction, no additional force is applied to the shaft body 76 to urge the same in one direction and hence it is possible to prevent the inclination of the laminating tape shaft 69 and the deviation thereof from its proper position. Further, it is also possible to effectively prevent the adhesion of the laminating tape T2 to the inner surface of the cartridge casing 64, which is caused by the loosening of the laminating tape T2. It is preferred that the direction of the winding of the brake spring 79 is set such that the brake spring 79 is being wound up by the rotation of the laminating tape shaft 69 when the laminating tape T2 is unwound.

The printing tape T1 and the laminating tape T2 constructed as above are fed out respectively by the feed rollers 41 comprised of the feed driven roller 42 and the feed drive roller 43 and by the laminating rollers 44 comprised of the laminating driven roller 45 and the laminating drive roller 46 and affixed to each other by the laminating rollers 44. In the present embodiment, the feed driven roller 42 and the laminating driven roller 45 each of which freely rotates are arranged in the tape cartridge 4*a*. It should be noted that in the following description of the tape cartridge 4 and component parts associated therewith, the auxiliary holding block side and the main holding block side are referred to as the "front" side and the "rear" side, respectively, which are "longitudinally" opposite to each other, while the direction of the width of the printing tape T1 is a "transverse" direction, except when a direction can be defined by using the words "leading end" and "trailing end".

Referring to FIGS. 3 and 4, the feed driven roller 42 and the laminating driven roller 45 are arranged in a manner opposed to each other with the connecting block 63 therebetween. The feed driven roller 42 and the laminating driven roller 45 are supported via support shafts 42*a* and 45*a* respectively on opposite inner portions of the cartridge casing 64 in a manner rotatable and at the same time movable in a vertical direction. In the main holding block 61 are incorporated a pair of feed urging levers 91 for pressing the feed driven roller 42 toward the above-mentioned feed drive roller 43, while in the auxiliary holding block 62 are incorporated a pair of laminating urging levers 92 for urging the laminating driven roller 45 toward the laminating drive roller 46.

Each feed urging lever 91 abuts from above against the support shaft 42*a* of the feed driven roller 42 at a leading end 93 thereof and is supported on the cartridge casing 64 via a shaft 94 formed on an intermediate portion thereof at a location closer to the leading end 93 than a trailing end such that it may pivot, i.e. in a manner swingable about the shaft 94. At the trailing end of each feed urging lever 91 there are formed an abutment portion 95 which extends downward for abutment against a feed urging arm 134, described hereinafter, of the latching mechanism 15, a rotation-inhibiting portion 96 extending upward for engagement with the above-mentioned rotation control block 75 of the tape shaft 68, and a grip 97 for being held by the user to move backward each feed urging lever 91 to disengage the leading end 93 from the support shaft 42*a* of the feed driven roller 42. Further, at an intermediate portion of each feed urging lever 91 on a trailing end side of the shaft 74 is provided a spring 98 extending downward in a diagonal direction such that the free end of the spring 98 abuts against the bottom of the cartridge casing 64, whereby the spring 98 urges the leading end side of each feed urging lever 91 in the downward direction and the trailing end side thereof in the upward direction.

In this state, each spring 98 applies a force urging the whole of each feed urging lever 91 in the upward direction, while each shaft 94 is in contact with a shaft-receiving recess, substantially semicircular cross-section, formed in the cartridge casing 64 from below, so that the shaft 94 is pivotally or swingably engaged with the shaft-receiving recess in a manner held down from above. The relationship between the shaft-receiving recess having the approximately semicircular cross-section and the above-mentioned grip 97 and their functions will be described in detail hereinafter.

When the tape cartridge 4*a* is in a non loaded-state, the rotation-inhibiting portion 96 of each feed urging lever 91 is lifted by the spring force of the spring 98 and brought into engagement with the rotation control block 75 of the tape shaft 68 to inhibit the rotation of the printing tape T1, while the leading end 93 of each feed urging lever 91 is lowered to move the feed driven roller 42 to the downward movement stop position. The feed driven roller 42 when moved to the downward movement stop position presses the printing tape T1 between itself and the cartridge casing 64. That is, when the tape cartridge 4*a* is in the non loaded-state, the printing tape T1 has its rotation controlled by the rotation-inhibiting portion 96 and at the same time has its feed controlled by the feed driven roller 42, which prevents the loosening of the printing tape T1 in the main holding block 61.

On the other hand, when the tape cartridge 4*a* is loaded in the apparatus body 2, the feed driven roller 42 abuts against the feed drive roller 43 of the apparatus body 2 to be slightly pushed upward. This causes the printing tape T1 to be released from a state being pressed between the feed driven roller 42 and the cartridge casing 64. Further, when the leading end 93 of each feed urging lever 91 is lifted, the trailing end thereof is lowered for disengaging the rotation-inhibiting portion 96 from the rotation control block 75, which frees the printing tape T1 to be unwound. At the same time, each abutment portion 95 is brought into contact with the feed urging arm 134 of the latching mechanism 15. The feed urging arm 134 presses the feed driven roller 42 via the feed urging lever 91 such that the feed driven roller 42 is always in rolling contact with the feed drive roller 43.

As described above, the feed driven roller 42 is incorporated in the tape cartridge 4*a*, whereby the printing tape T1 can be automatically sandwiched in the feed rollers 41 when the tape cartridge 4*a* is loaded in the apparatus body 2. That is, it is possible to omit a moving mechanism required in the case of the feed driven roller 42 being incorporated in the apparatus body 2 and at the same time simplify the construction of the tape printing apparatus 1. Further, the axial length of the feed driven roller 42 can be caused to correspond to the tape width of the printing tape T1, which makes it possible to laterally uniformly apply the pressure of the feed driven roller 42 to the printing tape T1, whereby it is possible to stably feed the printing tape T1. Moreover, each feed urging lever 91 is arranged along the full length of the main holding block 61 in a pivotally movable or swingable manner, so that a spring force can be applied from the feed urging arm 134 to the feed driven roller 42 by exploiting the mechanism of the lever and fulcrum. Therefore, a large spring force can be applied with a reduced spring constant of a spring (compression spring) associated with the feed urging arm 134 for pressing the feed driven roller 42 with stable force.

Although in this embodiment the feed driven roller 42 is pressed against the feed drive roller 43 by the pressure of the feed urging arm 134 of the latching mechanism 15, the above urging may be carried out by the urging force of a coiled spring 99 provided in the cartridge casing 64, as shown by phantom lines in FIG. 3. This makes it possible to apply the optimum pressure for the feed of the printing tape T1 to the feed driven roller 42 in a manner corresponding to the printing tape T1 contained, and at the same time not only omit space for a spring mounted in the apparatus body but also simplify the construction of the tape printing apparatus 1.

Similarly to the case of the above each feed urging lever 91, each laminating urging lever 92 abuts from above against the support shaft 45*a* of the laminating driven roller 45 at a leading end 101 thereof and is pivotally or swingably supported on the cartridge casing 64 via a shaft 102 formed on an intermediate portion thereof at a location closer to the leading end 101 than a trailing end. At the trailing end of the laminating urging lever 92, there are formed an abutment portion 103 extending downward and abutting against a laminating urging arm 135, described hereinafter, of the latching mechanism 15 and a spring 104 extending downward in a diagonal direction. When the tape cartridge 4*a* is loaded in the apparatus body 2, the laminating driven roller 45 is brought into contact with the laminating drive roller 46 of the apparatus body 2 to be pushed upward. At the same time, the abutment portion 103 abuts against the above-mentioned laminating urging arm 135. The laminating urging arm 135 presses the laminating driven roller 45 via the laminating urging lever 92 such that the laminating driven roller 45 is always in rolling contact with laminating drive roller 46.

In the auxiliary holding block 62 as well, the laminating driven roller 45 is incorporated in the tape cartridge 4*a*, whereby the printing tape T1 and the laminating tape T2 can be automatically pressed between the laminating rollers 44 when the tape cartridge 4*a* is loaded in the apparatus body 2. Further, the axial length of the laminating driven roller 45 can be caused to correspond to the tape width of the laminating tape T2, whereby it is possible to stably feed the laminating tape T2. Moreover, the laminating urging lever 92 is arranged along the full length of the auxiliary holding block 62 in a pivotally movable or swingable manner, so that a spring force from can be applied the laminating urging arm 135 to the laminating driven roller 45 by exploiting the mechanism of the lever and fulcrum. In this case as well, the laminating driven roller 45 may be pressed by employing the spring force of a coiled spring 105, shown by phantom lines in FIG. 3, in the cartridge casing 64.

The tape cartridge 4*a* thus configured is set to a predetermined printing position in the apparatus body 2 by the latching mechanism 15. When the tape cartridge 4*a* is set to the printing position, the feed driven roller 42 catches the printing tape T1 to roll on the feed drive roller 43, while the laminating driven roller 45 catches the printing tape T1 and the laminating tape T2 to roll on the laminating drive roller 46. To the connecting block 63 is brought the print head 33 from above. For this reason, there is provided an open space above the connecting block 63 where the printing tape T1 is fed in a state stretched in a horizontal direction.

The roll of printing tape T1 is unwound by the feed driven roller 42 and the feed drive roller 43. An unwound portion of the printing tape T1 is guided by a pair of tape guides 106 transversely arranged immediately before the feed driven roller 42 in the direction of feeding of the printing tape T1. That is, the printing tape t1 is controlled or limited in respect of the lateral position, i.e. the position in the direction of the width thereof by the pair of tape guides 106 for feeding out the same to a printing position. Further, in accordance with the position control by the tape guide 106, the printing tape T1 is slightly moved along the tape shaft 68 in the direction of the width thereof.

Similarly, the roll of the laminating tape T2 is unwound and fed such that an wound portion thereof is controlled in respect of the lateral position by a pair of laminating tape guides 107 transversely arranged immediately before the laminating driven roller 45 in the direction of feeding of the printing tape T1 to be fed out to a laminating position for laminating the same onto the printing tape T1. The above pair of tape guides 106 and the above pair of laminating tape guides 107 are arranged at positions which are identical with respect to the transverse direction and hence at the laminating position where the laminating driven roller 45 rolls on the laminating drive roller 46, the laminating tape T2 is accurately placed on the printing tape T1 in an aligned manner for lamination.

On the other hand, at opposite side portions of the connecting block 63 are formed a pair of ink collecting windows 108 (see FIG. 4). Each of the ink collecting windows 108 is square-shaped and arranged at a position from which a corresponding one of the lateral sides of the printing tape T1 being fed is exposed to the outside. Further, in the apparatus body 2 under each ink collecting window 108 there is arranged a waste ink absorber, not shown, for absorbing uselessly discharged ink. According to the tape printing apparatus 1, it is possible to print a background color in addition to characters, such as letters or the like. When the background color is printed, a printing operation (discharge of ink) is started from a position outward of the lateral edge of the printing tape T1 and hence ink for outside the lateral edge of the printing tape T1 is discharged toward each ink collecting window 108 and passes therethrough to be absorbed by the waste ink absorber.

At a central portion of a bottom of the casing body 65 on the main holding block side there is formed a guide groove 110 for guiding the loading of the tape cartridge 4*a* in the latching mechanism 15 (see FIG. 4). The guide groove 110 extends in the direction of the length of the tape cartridge 4*a* for engagement with a guide ridge 143, described hereinafter, of the latching mechanism 15. In this embodiment, the tape cartridge 4*a* is loaded in the latching mechanism 15 by inserting in the direction of the auxiliary holding block side. To this end, the guide groove 110 is provided with an increased-width portion 112 to which a locking/unlocking mechanism 16, described hereinafter, is brought, and an expanding block 113 for guiding the guide ridge 143 into the main holding block 61, at a front end of a groove 111 continuously along the length of the guide groove 110.

At each of a front portion and a rear portion of the groove 111, an urging nail 114 is formed by cutting out from the casing body 65. The two urging nails 114 face one side of the groove 111 such that they urge a side of the guide ridge 143 engaged with the guide groove 111, thereby enabling the tape cartridge 4*a* to be positioned to the latching mechanism 15 in the transverse direction. The positioning of the tape cartridge 4*a* to the latching mechanism 15 in the direction of the length thereof is effected by the locking/unlocking mechanism 16, described hereinafter. Further, reference numeral 115 shown in FIG. 3 designates a discriminating plate formed at an intermediate portion of a front-side surface of the main holding block 61. A sensor, not shown, mounted on the above-mentioned carriage 32 is caused to face toward the discriminating plate 115 to thereby detect the types of a tape cartridge 4, a printing tape T1 and a laminating tape T2 as well as a print-starting position at which the printing tape T1 starts to be printed.

Figure 9:
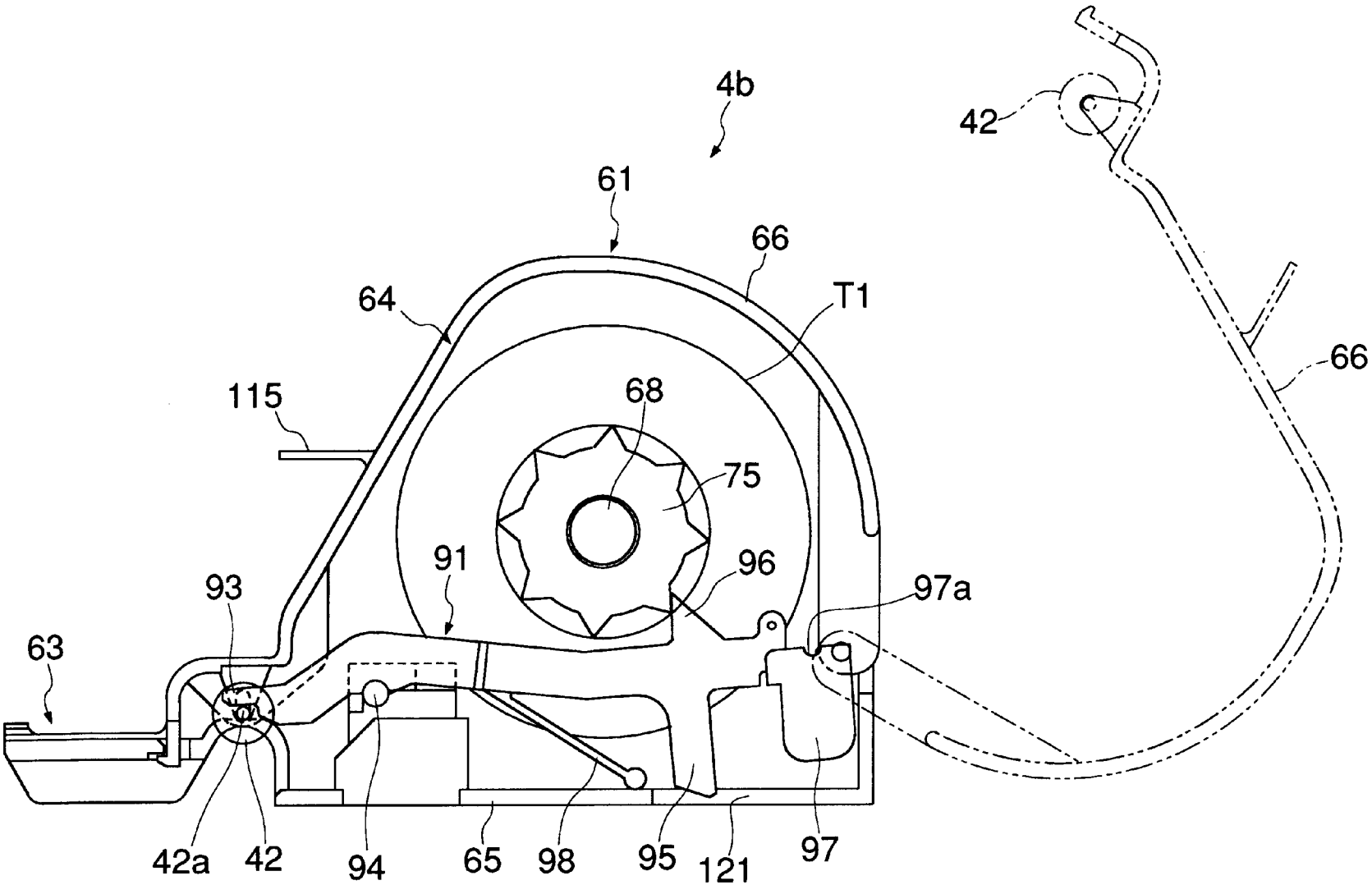
FIG. 9 is a side sectional view of a variation of the tape cartridge according to the embodiment.

Next, a tape cartridge 4*b* of a type containing only a printing tape T1 is described with reference to FIG. 9. As shown in the figure, the tape cartridge 4*b* includes no auxiliary holding block 62 but has a main holding block 61 and a connecting block 63, so that the printing tape T1, the tape shaft 68, the feed driven roller 42, and the pair of feed urging levers 91 are arranged in a cartridge casing 64 of the tape cartridge 4*b*.

Further, a main casing lid 66 of the tape cartridge 4*b* is attached to a casing body 65 in a manner such that it can be opened and closed for the user to replace the printing tape T1. The feed driven roller 42 is arranged in the main casing lid 66 and the main casing lid 66 is closed after unwinding the replaced printing tape T1 until an unwound portion of the same extends out of the cartridge, whereby the printing tape T1 can be suitably set to an initial state. In this case, the leading end 93 of each feed urging lever 91 is engaged with the support shaft 42*a* of the feed driven roller 42 from above and hence when the main casing lid 66 is opened, the feed urging lever 91 prevents the feed driven roller 42 from being lifted.

Therefore, in this embodiment, the feed urging levers 91 can be moved by operating from outside so as to detach the same from the feed driven roller 42. That is, the casing body 65 is formed with an opening 121 for a user's manual operation at a location corresponding to a grip 97 provided at the trailing end of the feed urging lever 91. By seizing the grip 97 through the opening 121 and drawing the same backward, the leading end 93 of the feed urging lever 91 is detached from the support shaft 42*a* of the feed driven roller 42. Simultaneously, the shaft 94 of the feed urging lever 91 is pulled out from the shaft-receiving recess of the casing body 65 and moved backward along a horizontal groove following the shaft-receiving recess. And, a concave portion 97*a* formed on an upper end of the grip 97 is hooked on an edge of the opening 121 by utilizing the spring force of a spring 98 to thereby stabilize the feed urging lever 91 moved backward.

It should be noted that the tape cartridge 4*b* is not provided with a laminating driven roller 45 and hence, the printing tape T1 is fed forward from the printing device 12 by using a sub-driven roller 191, described hereinafter, arranged in the apparatus body 2. That is, the apparatus body 2 incorporates a sub-roller guide mechanism 17 that brings the sub-driven roller 191 into rolling contact with the laminating drive roller when the tape cartridge 4*b* having no auxiliary holding block 62 therein is loaded in the apparatus body 2 (see FIG. 15). The sub-roller guide mechanism will be described in detail hereinafter.

Figure 10:
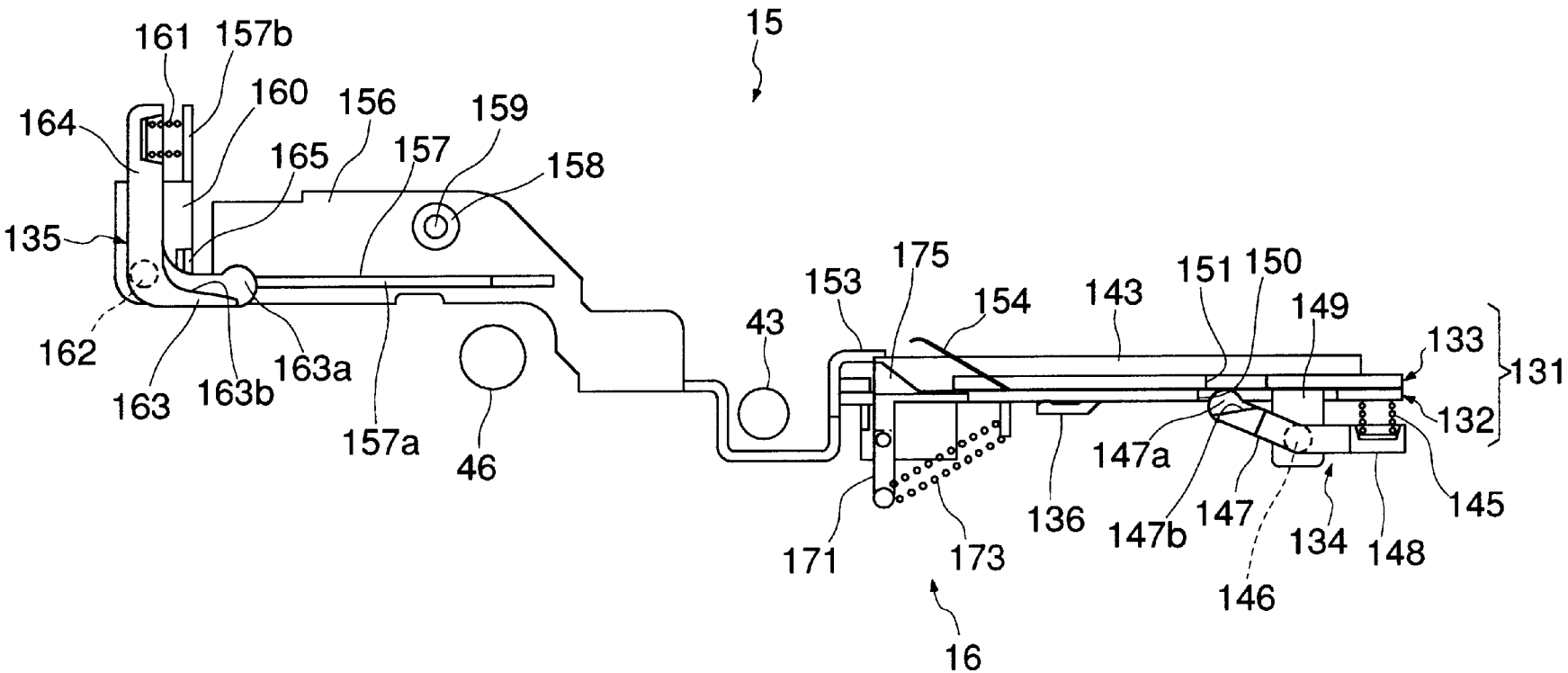
FIG. 10 is a side view of a latching mechanism.
Figure 11:
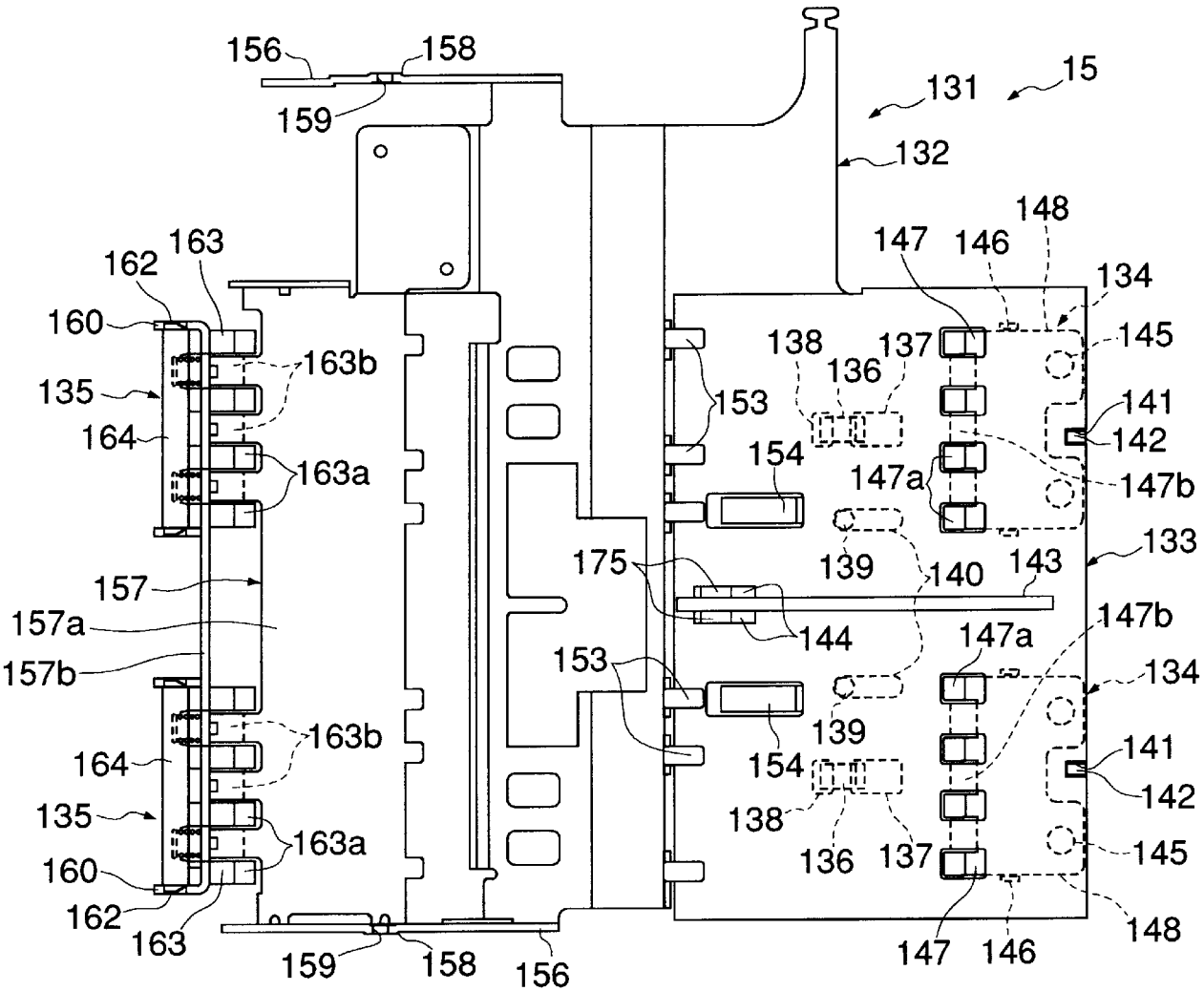
FIG. 11 is a plan view of the latching mechanism.

Next, the latching mechanism 15 is described with reference to FIGS. 10 and 11. The latching mechanism 15 is configured to be movable between a cartridge-inserting position where the tape cartridge 4 can be inserted therein and drawn out therefrom and a printing position where proper alignment is insured and devices can access the tape cartridge 4. When the latching mechanism 15 is in the cartridge-inserting position, it is inclined with a front end-side lifted, and from this position the latching mechanism 15 is pivoted about its front end to be made horizontal, whereby it is secured in the printing position (see FIGS. 13 and 14).

In this process, the movement of the latching mechanism 15 from the cartridge-inserting position to the printing position and the movement thereof from the printing position to the cartridge-inserting position are carried out in a manner interlocked with the opening and closing of the lid 7 using a spring and damper means, neither of which is shown, incorporated in the apparatus body 2. Further, the latching mechanism 15 is rigidly locked into the printing position by locking means, not shown, while it is unlocked in response to the opening operation of the lid 7 utilized as a trigger.

The latching mechanism 15 includes an latching plate 131 comprised of a main latching plate 132 and an auxiliary latching plate 133. The main latching plate 132 is large enough to have a tape cartridge of a maximum size set thereon. The auxiliary latching plate 133 is provided at a portion of the latching mechanism 15 at which the main holding block 61 of the loaded tape cartridge 4 is located, in a manner placed on the main latching plate 132 (see FIG. 14). To the rear end of the auxiliary latching plate 133 are attached the feed urging arms 134 in a pair which abut against the feed urging levers 91 of the tape cartridge 4 set in the printing position, for pressing the same to lift it. Similarly, to the front end of the main latching plate 132 are attached the laminating urging arms 135 in a pair which abut against the laminating urging levers 92 of the tape cartridge 4 set in the printing position, for pressing the same to lift it (see FIG. 14). Further, on the bottom of an intermediate portion of the main latching plate 132 is mounted the locking/unlocking mechanism 16 for fixedly setting the tape cartridge 4 loaded on the latching mechanism 15 to the latching plate 131.

The auxiliary latching plate 133 is formed of a square-shaped resin plate or the like, which is removably mounted on the top of the main latching plate 132 by a pair of mounting hooks 136 formed on the bottom thereof. Each mounting hook 136 extends downward through a distance corresponding to the thickness of the main latching plate 132 and then extends forward to form an upward projection at its front end. On the other hand, the main latching plate 132 is formed with a first pair of openings 137 into which the pair of mounting hooks 136 are freely inserted and a second pair of openings 138 located forward of the first pair of openings 137. After the auxiliary latching plate 133 is placed on the main latching plate 132 in a manner such that the pair of mounting hooks 136 are fitted in the first pair of openings 137, the auxiliary latching plate 133 is advanced, whereby the front ends of the mounting hooks 136 are brought into engagement with the second openings 138 to thereby mount the auxiliary latching plate 133 on the main latching plate 132.

The auxiliary latching plate 133 has a pair of circular projections 139 formed on the underside surface of the central portion thereof, while the main latching plate 132 has a pair of elongated slots 140 at the central portion thereof. The pair of circular projections 139 of the auxiliary latching plate 133 are engaged with the pair of elongated slots 140 of the main latching plate 132 and at the same time a pair of cutout portions 141 formed at a trailing end of the auxiliary latching plate 133 are engaged with a pair of convex portions 142 formed at a trailing end of the main latching plate 132, whereby the auxiliary latching plate 133 is positioned properly relative to the main latching plate 132.

Further, at the central portion of the top of the auxiliary latching plate 133 is formed the guide ridge 143 to be engaged with the guide groove 110 of the tape cartridge 4. At a location closer to the front end of the guide ridge 143, on opposite sides of the same there are formed a pair of through holes 144 in the auxiliary latching plate 133. A pair of posts 175, described hereinafter, of the locking/unlocking mechanism 16 extend through the pair of through holes 144 to engage with the tape cartridge 4 loaded on the auxiliary latching plate 133.

The pair of feed urging arms 134 are arranged below the main latching plate 132 at respective locations symmetric with respect to the guide ridge 143, and urge the respective feed urging lever 91, described above, upward by the urging forces of two compression springs 145. Each feed urging arm 134 is comprised of a contact block 147 in contact with each feed urging lever 91 of the tape cartridge 4 and a spring-holding block 148 for engagement with the compression springs 145, which are continuous but located on opposite sides with respect to pivot shafts 146 extending laterally outward from a boundary of these blocks 147, 148. Each contact block 147 has four contact portions 147*a* positioned in a manner that corresponds to tape cartridges 4 of the various types ("large", "medium", "small" and "spare") having different widths. The contact portions 147*a* are connected to each other by a stopper portion 147*b*. Each pivot shaft 146 is supported by a pair of shaft-holding portions 149 extending from the underside of the auxiliary latching plate 133. Each pair of the compression springs 145 are interposed between the top of each spring-holding block 148 and the bottom of the main latching plate 132.

Each feed urging arm 134 is urged by the compression springs 145 and brought into contact with each feed urging lever 91 of the tape cartridge 4 via a lower arm opening 150 formed through the main latching plate 132 and an upper arm opening 151 formed through the auxiliary latching plate 133 in a manner corresponding to the lower arm opening 150. When the tape cartridge 4 is loaded on the latching mechanism 15 (latching plate 131) which is in the cartridge-inserting position, the feed driven roller 42 is not in contact with the feed drive roller 43 and the trailing end (including the abutment portion 95) of each feed urging lever 91 is held in a lifted state. On the other hand, each feed urging arm 134 is urged by the compression springs 145 to be pivotally moved to the pivot stop position where the stopper portion 147*b* abuts against the bottom of the main latching plate 132. When the tape cartridge 4 in this state is moved to the printing position in accordance with the movement of the latching plate 131, the feed driven roller 42 is brought into contact with the feed drive roller 43, while the trailing end of the feed urging lever 91 abuts against the feed urging arm 134, whereby the feed urging arm 134 is slightly rotated against the compression springs 145 and at the same time presses the feed driven roller 42 toward the feed drive roller 43 by way of the feed urging lever 91.

At an intermediate portion of the main latching plate 132 along its length, there are provided six retaining projections 153 for engagement with the loaded tape cartridge 4 to prevent the same 4 from being detached upward. Each of the retaining projections 153 rises upward through a distance corresponding to the thickness of the auxiliary latching plate 133 and the thickness of the casing body 65 of the tape cartridge 4 and then extends backward. When the tape cartridge 4 is loaded on the latching mechanism 15, part of the casing body 65 of the tape cartridge 4 is inserted between the retaining projections 153 and the auxiliary latching plate 133. A pair of leaf springs 154 are attached to the front portion of the top of the auxiliary latching plate 133 at respective locations symmetric with respect to the guide ridge 143 and corresponding to the retaining projections 153. The leaf springs 154 are provided to prevent the leading end of the printing tape T1 (laminating tape T2) slightly drawn out from the tape cartridge 4 from being caught in the retaining projections 153 when the tape cartridge 4 is loaded on the latching plate 131.

The intermediate portion of the main latching plate 132 along its length is bent downward at a location in front of the retaining projections 153 so that it clears the feed drive roller 43 and then extends forward. A pair of side plates 156 rise from the portion extending forward, and support plates 157, for mounting the above laminating urging arms 135, extend forward from the side plates. A thick portion 158 having a circular shape is formed at an upper intermediate portion of each side plate 156 and a circular hole 159 is formed at the center of each thick portion 158. Side plates 18*a* of a frame 18 of the apparatus are arranged on opposite sides of the latching mechanism 15 (see FIG. 16) and shafts inwardly extend from the side plates 18*a*. Each of the above circular holes 159 is fitted on a corresponding one of the shafts. That is, the latching plate 131 is supported on the shafts of the side plates 18*a* of the frame 18 at the circular holes 159 thereof and able to pivot such that it can be moved between the cartridge-inserting position and the printing position about the circular holes 159.

The support plate 157 comprised of a horizontal plate 157*a* and a vertical plate 157*b* has a generally L-shaped cross-section, and the above-mentioned pair of laminating urging arms 135 are attached to the vertical plate 157*b*. The vertical plate 157*b* has two pairs of bent portions U-shaped in plan view at respective transverse locations. Each laminating urging arm 135 is pivotally supported on the pair of bent portions 160. In this case as well, similarly to the above-mentioned pair of feed urging arms 134, the pair of laminating urging arms 135 are arranged at respective locations symmetric with respect to the center line on the guide ridge 143, for urging the respective laminating urging levers 92 in a direction of lifting them by the urging forces of two compression springs 161.

Each of the laminating urging arms 135 is comprised of a contact block 163 in contact with the laminating urging lever 92 of the tape cartridge 4 and a spring-holding block 164 for engagement with the compression springs 161, which are continuous but located on opposite sides with respect to a pivot shaft 162 extending laterally outward from a boundary of these blocks 163, 164. Each contact block 163 has four contact portions 163*a* in a manner that corresponds to tape cartridges 4 of the various types ("large", "medium", small and "spare") having different widths. The contact portions 163*a* are connected to each other by a stopper portion 163*b*. The pivot shaft 162 is supported on the pair of bent portions 160. The compression springs 161 are interposed between the upper portion of the spring-holding block 164 and the vertical plate 157*b*.

Each laminating urging arm 135 is urged by the compression springs 161 and brought into contact with each laminating urging lever 92 of the tape cartridge 4 via an arm opening 165 formed through the portion connecting the horizontal plate 157*a* and the vertical plate 157*b*. When the tape cartridge 4 is loaded on the latching mechanism 15 (latching plate 131) in the cartridge-inserting position, the laminating driven roller 45 is not in contact with the laminating drive roller 46 and the trailing end (abutment portion 103) of each laminating urging lever 92 is held in a lifted state. On the other hand, each laminating urging arm 135 is urged by the compression springs 161 to be moved to a pivot stop position where the stopper portion 163*b* abuts against the bottom of the horizontal plate 157*a*. When the tape cartridge 4 in this state is moved to the printing position in accordance with the movement of the latching plate 131, the laminating driven roller 45 is brought into contact with the laminating drive roller 46, while the trailing end of each laminating urging lever 92 abuts against the corresponding laminating urging arm 135, whereby the laminating urging arm 135 is slightly rotated against the compression springs 164 and at the same time urges the laminating driven roller 45 towards the laminating drive roller 46 by way of each laminating urging lever 92.

Figure 12:
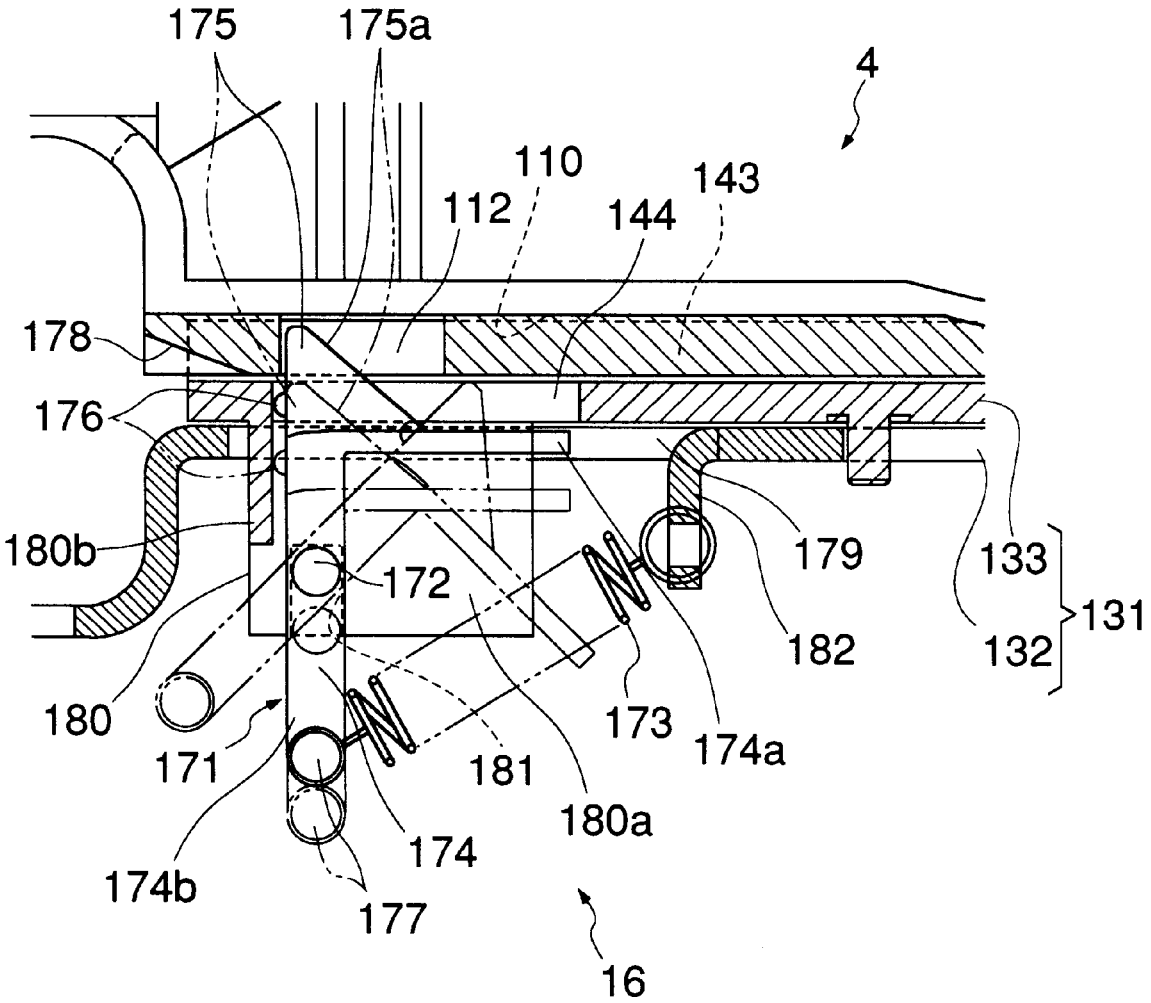
FIG. 12 is a side view of a locking/unlocking mechanism.

Next, the locking/unlocking mechanism 16 will be described with reference to FIGS. 10 to 12. The locking/unlocking mechanism 16 includes a locking post member 171, which moves in the vertical direction, and is engaged from below with the tape cartridge 4 when the tape cartridge 4 is loaded on the latching plate 131 to fixedly position the tape cartridge 4 to the latching mechanism 15. That is, when the tape cartridge 4 is inserted along the latching plate 131 to the innermost position, a leading end of the locking post member 171 is inserted into the increased-width portion 112 of the guide groove 110 of the tape cartridge 4 and holds the tape cartridge 4 at the innermost position of the latching plate 131.

The locking/unlocking mechanism 16 includes the locking post member 171, a shaft member 172 for supporting the locking post member 171 in a pivotal and vertically slidable manner and a coiled spring 173 for urging the locking post member 171 in the direction of engagement with the tape cartridge 4. The locking post member 171 is comprised of a body 174 formed by a horizontal portion 174*a* and a downward-projecting portion 174*b* and having an inverted L-shape in side view, a pair of posts 175 formed on the top of the horizontal portion 174*a* and an abutting portion 176 projecting forward from a front-side surface of each post 175. On one side of the lower end of the downward-projecting portion 174*b* is provided a catch pin 177 protruding laterally outward for catching the coiled spring 173.

The pair of posts 175 are spaced such that they sandwich the guide ridge 143 of the auxiliary latching plate 133 therebetween. The posts extend and retract from the above pair of through holes 144 formed through the auxiliary latching plate 133 with the guide ridge 143 located therebetween similarly to the posts 175, for locking/unlocking the tape cartridge 4. Each post 175 is wedge-shaped with a sloped portion 175*a* sloping upward on its rear side, while on each of inner walls of the expanding block 113 of the tape cartridge 4, a sloped portion 178 sloping downward is formed in a manner corresponding to the sloped portion 175*a*. When the tape cartridge 4 is inserted along the auxiliary latching plate 133, the sloped portions 178 of the tape cartridge 4 hit the sloped portions 175*a* of the posts 175 to advance in a manner pushing down the posts 175. When the sloped portions 178 pass the posts 175 and the tape cartridge 4 reaches the innermost position of the latching plate 131, both the posts 175 correspond to the increased-width portion 112 in position and the posts 175 are lifted to engage with the front inner walls of the increased-width portion 112.

On the other hand, the main latching plate 132 is formed with an incorporating opening 179 for incorporating the locking/unlocking mechanism 16 in the latching mechanism 15. Through the incorporating opening 179, a post member-mounting block 180 extends downward from the lower peripheral portion of the above-mentioned through holes 144 of the auxiliary latching plate 133. The post member-mounting block 180 has side walls 180*a* and a front wall 180*b*, and the above shaft member 172 engages with shaft-holding grooves 181 formed in respective side walls 180*a* to support the locking post member 171 in a pivotal and vertically movable manner. Further, in this state, the abutting portions 176 formed in the front-side surfaces of the respective posts 175 abut against the front wall 180*b* to hold the locking post member 171 in the vertical orientation. That is, the locking post member 171 is guided by the shaft-holding grooves 181 of the side walls 180*a* and the front wall 180*b* for upward and downward movements, while pivoting about the shaft member 172 from this state only in a backward (clockwise as viewed in FIG. 12) direction.

The main latching plate 132 is formed with a spring-mounting portion 182 bent downward immediately before the incorporating opening 179 and the coiled spring 173 is stretched between the spring-mounting portion 182 and the catching pin 177 of the locking post member 171. The coiled spring 173 is stretched forward and downward toward the catching pin 177 to thereby urge the locking post member 171 in the upward direction as well as pivotally urge the same in the counterclockwise direction as viewed in FIG. 12. As a result, when the tape cartridge 4 is inserted to the innermost position of the latching plate 131, the locking post member 171 is lifted up for locking the tape cartridge 4 to the latching plate 131, whereas when the tape cartridge 4 in this state is strongly drawn backward, the locking post member 171 is pivotally moved against the spring force of the coiled spring 173 in the clockwise direction as shown in FIG. 12 to unlock the tape cartridge 4, whereby the tape cartridge 4 can be drawn out from the latching plate 131.

As described above, the tape cartridge 4 is fixedly set to the latching plate 131 by using the locking/unlocking mechanism 16 and hence it is possible to always stably locate the tape cartridge 4 to a predetermined position such that it is properly aligned and accessible to the various kinds of devices. Further, the coiled spring 173 is stretched forward and downward, whereby the locking/unlocking operations can be carried out in a regulated manner to enable the construction of the locking/unlocking mechanism to be made very simple.

Figure 13:
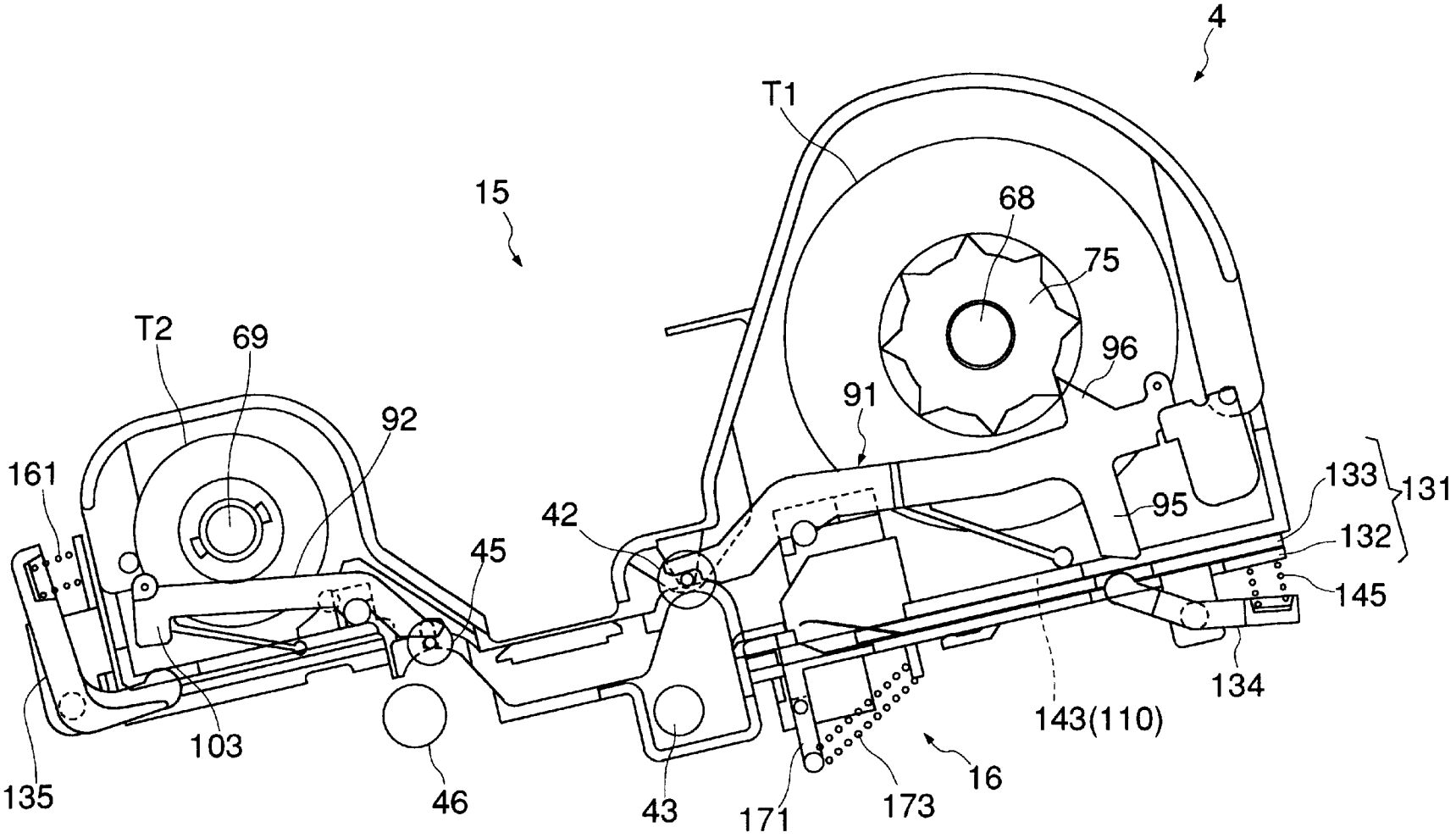
FIG. 13 is a diagram which is useful in explaining operation of the latching mechanism (in a cartridge-inserting position)
Figure 14:
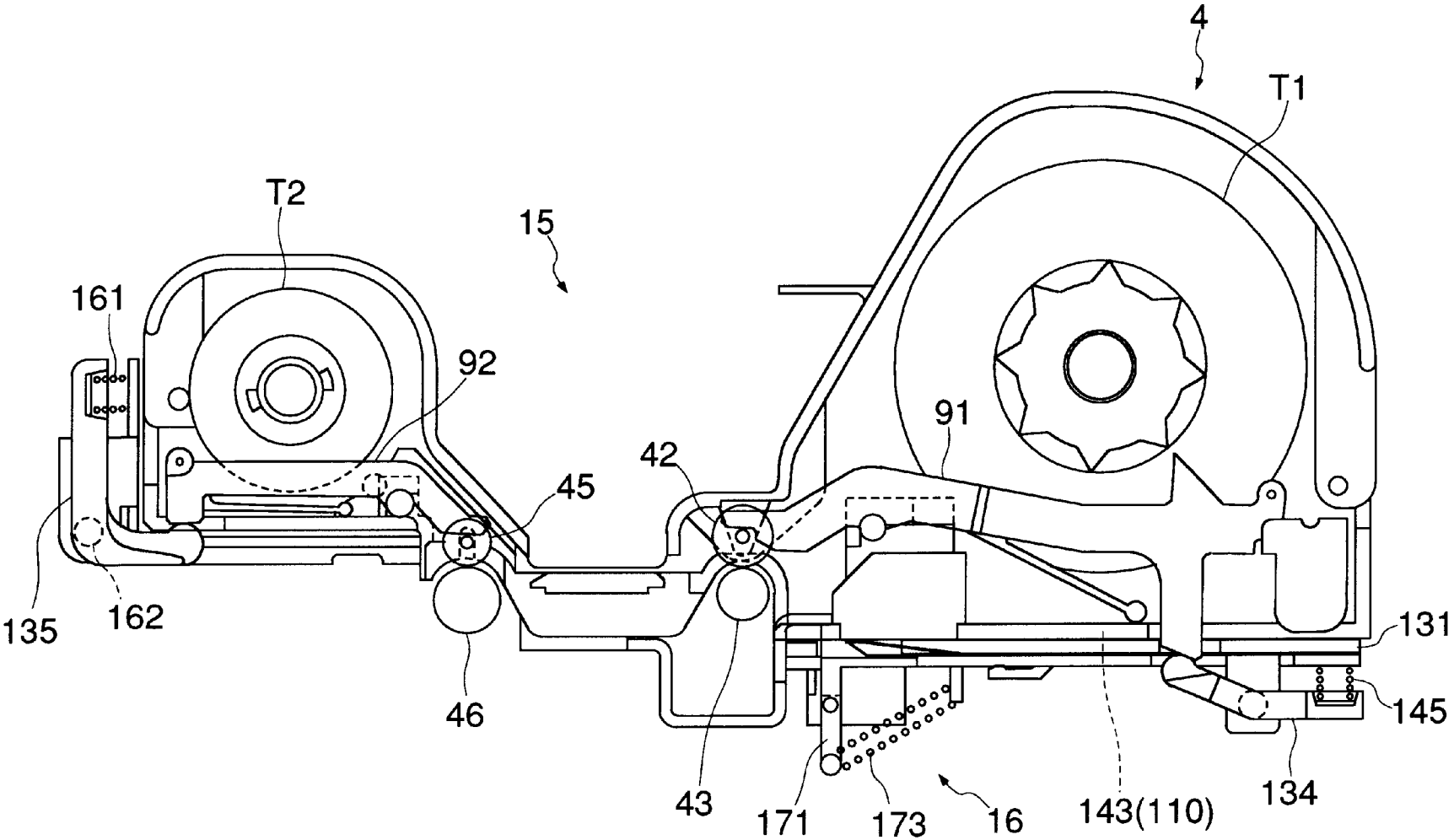
FIG. 14 a diagram which is useful in explaining the operation of the latching mechanism (in a printing position)

Now, the operation of the latching mechanism 15 including the locking/unlocking mechanism 16 is described with reference to FIGS. 13 and 14. When the lid 7 is opened, the latching mechanism 15 is moved to the cartridge-inserting position in a fashion interlocked with the opening operation of the lid 7 for lifting the trailing end side of the latching plate 131. At this time, the user holds the tape cartridge 4 to mount the same on the latching plate 131 and then uses the guide ridge 143 for insertion of the tape cartridge 4 into an inner (forward) position of the latching plate 131. When the tape cartridge 4 is inserted to the innermost position of the latching plate 131, the locking post member 171 is lifted to thereby lock the tape cartridge 4 to the latching mechanism 15 (see FIG. 13).

Next, when the lid starts to be closed, immediately before closing of the lid, the tape cartridge 4 and the latching plate 131 pivot about the circular holes 159 provided at the front portion of the latching plate 131. In accordance with the above pivotal movement of the tape cartridge 4 and the latching plate 131 to the printing position, the feed driven roller 42 is brought into contact with the feed drive roller 43, while the laminating driven roller 45 is brought into contact with the laminating drive roller 46. When the pivotal movement further proceeds for carrying the latching mechanism 15 to the printing position, the latching mechanism 15 is locked and the feed driven roller 42 is slightly pushed upward by the feed drive roller 43 and the laminating driven roller 45 is also slightly pushed up by the laminating drive roller.

When the feed driven roller 42 is pushed upward, the feed urging levers 91 are pivotally moved to be brought into contact with the feed urging arms 134 and urged upward by the same, whereby the feed driven roller 42 is brought into rolling contact with the feed drive roller 43 with a predetermined force. Similarly, when the laminating driven roller 45 is pushed upward, the laminating urging levers 92 are pivotally moved to abut against the laminating urging arms 135. The laminating driven roller 45 is brought into rolling contact with the laminating drive roller 46 with a predetermined forced (see FIG. 14). When the rollers 42, 45 roll on the rollers 43, 46, the printing tape T1 and the laminating tape T2 beforehand drawn out from the tape cartridge 4 are pressed therebetween. Therefore, by setting the tape cartridge 4 to the printing position in a state loaded on the latching mechanism 15, the tape cartridge 4 is made ready for feeding tapes. Actually, when the tape cartridge 4 is set to the printing position, the lid 7 is simultaneously and completely closed to place the tape printing apparatus 1 in a printing wait state.

Next, description will be made of a case where the tape cartridge 4 is taken out from the apparatus body 2 (including a case of replacement thereof). When the lid 7 is opened (e.g. after a release button, not shown, is depressed), the latching mechanism 15 is unlocked and slowly pivots from the printing position to the cartridge-inserting position. At this time, the tape cartridge 4 is firmly drawn backward, whereby the locking post member 171 is pivotally moved to unlock the locking/unlocking mechanism 16 and the tape cartridge 4 is drawn out from the latching mechanism 15.

Next, the sub-roller guide mechanism 17 is described with reference to FIGS. 15 and 16. As described above, the sub-roller guide mechanism 17 is used when the sub-driven roller 191 is substituted for the laminating driven roller 45 as a roller rolling on the laminating drive roller 46. That is, when the tape cartridge **4*b* that includes no laminating tape T2 is loaded, the sub-roller guide mechanism 17 moves the sub-driven roller 191 from a retracted position to a guide position in rolling contact with the laminating drive roller 46**.

The sub-roller guide mechanism 17 includes the sub-driven roller 191, a roller support member 192 pivotally mounted on the side walls **18*a* of the frame 18, for supporting the sub-driven roller 191 on one end thereof, a pair of torsion coiled springs 193 attached to the roller support member 192 acting as a spring force-receiving member, for pressing the sub-driven roller 191 towards the laminating drive roller 46, and a pair of urging cam mechanisms 194 which are interlocked with the pivotal movement of the latching plate 131 from the cartridge-inserting position to the printing position to press the sub-driven roller 191 toward the laminating drive roller 46 via the roller support member 192**.

The roller support member 192 is comprised of a pair of support arms 195 and a connecting plate 196 for connecting the pair of support arms 195 to each other. Each of the support arms 195 has an end thereof formed with a vertically-extending elongated slot 197 which supports the sub-driven roller 191 in a vertically movable manner. Further, each of the support arms 195 has a root end thereof arranged along and inside the corresponding side wall **18*a* of the frame 18, and pivotally mounted on each side wall 18*a* of the frame 18 by a shaft pin 199 with a spacer 198 interposed between the root end and the side wall 18*a*. The roller support member 192 pivots between the guide position of the sub-driven roller 191 in which the support arms 195 are brought to a substantially horizontal position and the retracted position of the sub-driven roller 191 in which the support arms 195** are brought to a substantially upright or vertical position.

Figure 17:
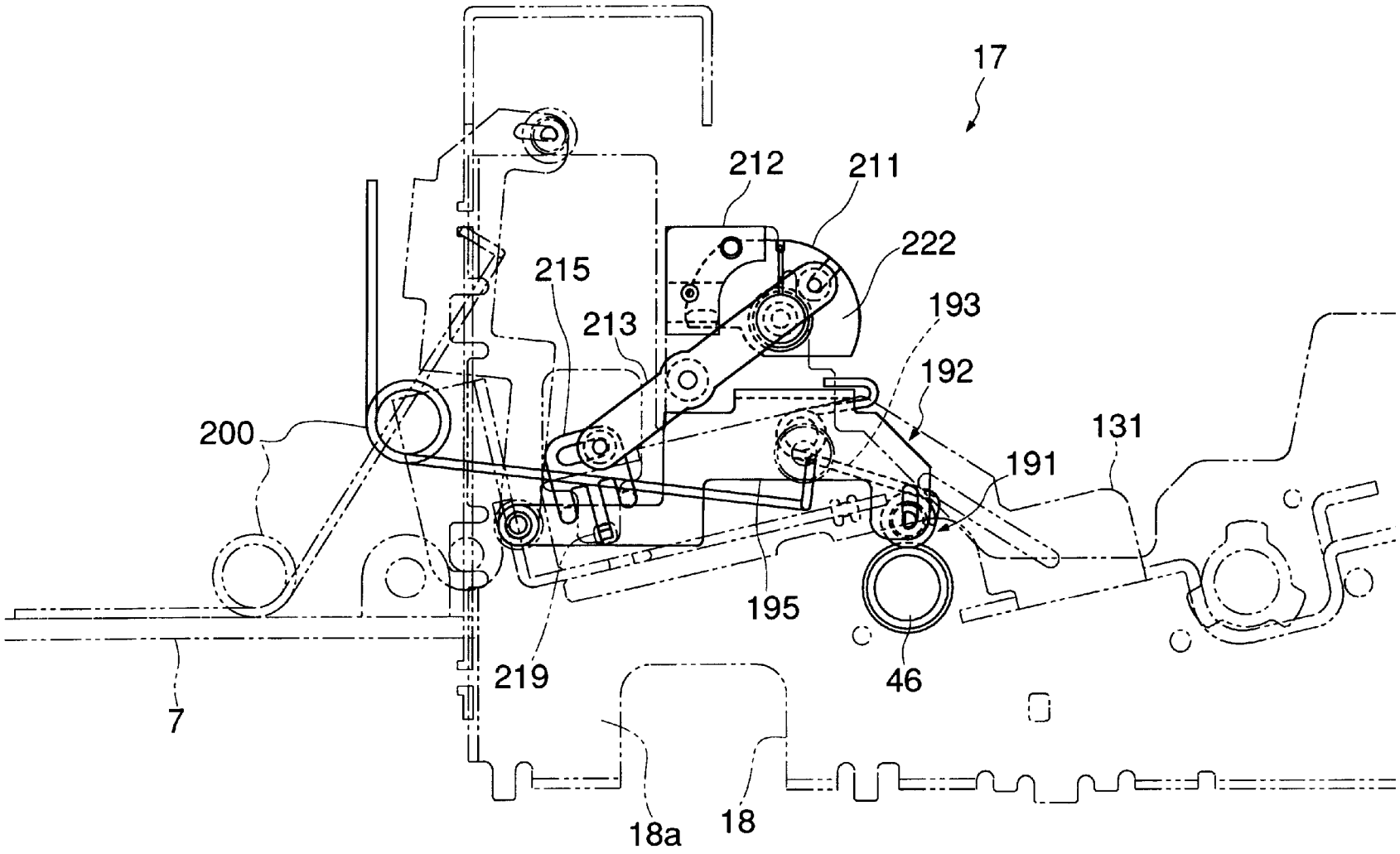
FIG. 17 is a diagram which is useful in explaining operation of the sub-roller guide mechanism.

As shown in FIG. 17, the lid 7 has a pair of lid-opening springs 200 provided therefor for urging the lid 7 in the direction of opening of the same. Each lid-opening spring 200 is implemented by a torsion coiled spring or the like and arranged such that one end thereof is fixed to the inside of the lid 7 and the other end extends into the apparatus body 2 in a released state and located below each support arm 195. When the lid 7 is opened, the other end of each lid-opening spring 200 pivots obliquely upward to thereby cause the sub-driven roller 191 to pivotally move to the retracted position thereof by lifting the roller support member 192. Inversely, when the lid 7 starts to be closed, the other end of each lid-opening spring 200 pivots obliquely downward according to the closing operation until it abuts against the latching plate 131 and in the state of the lid 7 being completely closed, each lid-opening spring 200 is bent to thereby urge the lid 7 in the direction of opening of the same. Simultaneously, the roller support member 192, which is slightly inclined forward when it is in the retracted position, is brought to a horizontal position by the weight thereof in a manner following the pivoting lid-opening springs 200 to move to the guide position. If the tape cartridge 4*a* containing a laminating tape is loaded on the latching mechanism 15, when the roller support member 192 is brought to the horizontal position, the sub-driven roller 191 simultaneously hits the auxiliary holding block 62 of the tape cartridge 4*a* to maintain the resulting state.

The sub-driven roller 191 is comprised of a sub-roller shaft 201, a center roller 202 and two side rollers 203. The center roller 202 and the side rollers 203 are rotatably fitted on the sub-roller shaft 201. The center roller 202 is disposed at a transversely or axially intermediate position of the sub-roller shaft 201 and the two side rollers 203 are arranged at respective locations symmetric with respect to the center roller 202 at predetermined spaced intervals from the center roller 202. The sub-roller shaft 201 has outer or lateral ends 204 engaged with the elongated slots 197 of the respective support arms. Each outer end 204 has a small diameter and a semicircular cross-section and is supported in each of the elongated slots 197 in a vertically movable but non-pivotable manner.

The pair of torsion coiled springs 193 are each mounted on the connecting plate 196 of the roller support member 192. The connecting plate 196 is formed with a pair of U-shaped cutouts which form tongue-shaped portions bent downward into L shapes to form a pair of fitting portions 205 on which are fitted the torsion coiled springs 193. Each torsion coiled spring 193 has a fixed end 193*a* abutting against the underside of the connecting plate 196 from below and an urging end 193*b* which applies pressure by abutting against a portion of the sub-roller shaft 201 between the center roller 202 and each side roller 203 from above. Thus, the sub-driven roller 191 is urged downward by the pair of torsion coiled springs 193.

Each urging cam mechanism 194 is comprised of an pressure block 211 which pivots for pressing the roller support member 192 from above, a cam block 212 for transversely moving the pressure block 211 in accordance with the pivotal movement of the pressure block 211, a swing link 213 causing the pressure block 211 to pivot and a connecting member 214 connecting the root end of the swing link 213 to the latching plate 131. When the latching plate 131 pivots from the cartridge-inserting position to the printing position, the swing link 213 is caused to swing by way of the connecting member 214 and to pivot the pressure block 211. When pivoted, the pressure block 211 is advanced transversely by dual cam action between the pressure block 211 and the cam block 212 and brought to the top of the connecting plate 196 of the roller support member 192 to urge the connecting plate 196 by the outer peripheral surface thereof.

Each connecting member 214 is comprised of a body 215 having a connecting hole 216 in the shape of an elongated slot for engagement with the swing link 213, a pair of legs 217 extending downward from the body 215 and a hook 218 extending downward from the body 215 at a location between the legs 217. The legs 217 and the hook 218 are arranged in a manner displaced or spaced from each other by approximately the thickness of (one of the side plates 156 of) the latching plate 131 transversely or in the inward and outward directions of the sub-roller guide mechanism 17. The legs 217 and the hook 218 press the latching plate 131 therebetween and the tip of the hook 218 is brought into engagement with a cutout opening 219 of the latching plate 131, whereby the legs 217 and the hook 218 are removably attached to the latching plate 131.

Each swing link 213 is pivotally attached to a sub-frame 19 extending from the frame 18 at the intermediate portion thereof. The swing link 213 has one end thereof engaged with a connecting hole 216 of the connecting member 214 by a first pin 220 and the other end thereof is engaged with (a body 222 of) the pressure block 211 by a second pin 221. When the latching plate 131 pivots from the cartridge-inserting position to the printing position, the swing link 213 is caused to swing clockwise, as viewed in FIG. 15, by way of the connecting member 214 and to thereby pivot (the body 222 of) the pressure block 211 in the clockwise direction, as viewed in the figure. Inversely, when the latching plate 131 pivots from the printing position to the cartridge-inserting position, the swing link 213 is caused to swing counterclockwise, as viewed in FIG. 17, by way of the connecting member 214 and to pivot (the body 222 of) the pressure block 211 in the counterclockwise direction, as viewed in the figure.

Each pressure block 211 is comprised of the block body 222 and a shaft member 223 supporting the block body 222 pivotally and at the same time in a manner such that the block body 222 is capable of moving transversely. The shaft member 223 is formed of a large-diameter portion 223*a* and a small-diameter portion 223*b*. The large-diameter portion 223*a* is rigidly fitted on the sub-frame 19, while the small-diameter portion 223*b* supports the block body 222 thereon. The block body 222 has a generally semicircular shape in side view, which has one end surface thereof formed with an elongated groove 224 for engagement with the second pin 221 of the swing link 213 and the other end surface thereof formed with a contact projection 225 in contact with the cam block 212.

When the latching plate 131 is in the cartridge-inserting position, a chord portion surface 222*a* of each block body 222 is opposed to the connecting plate 196 of the roller support member 192 at a spaced interval, whereas when the latching plate 131 pivots from the cartridge-inserting position to the printing position, the chord portion surface 222*b* of the block body 222 is brought into contact with the connecting plate 196 to press the same. Inversely, when the latching plate 131 pivots from the printing position to the cartridge-inserting position, the chord portion surface 222*b* of the block body 222 is separated from the connecting plate 196 to release the connecting plate 196.

Around the large-diameter portion 223*a* of the shaft member 223 is wound an extension spring 226 for pulling the block body 222 which has one end thereof rigidly fitted on the sub-frame 19 and the other end rigidly fitted on the block body 222. The cam block 212 is attached to the sub-frame 19 and on a portion thereof with which the contact projection 225 is brought into sliding contact is formed a cam slope 212*a* in a manner extending in a direction of the pivotal movement of the block body 222. That is, each cam mechanism for transversely advancing the block body 222 is constructed by the contact projection 225 of the block body 222 and the cam slope 212*a* of each cam block 212 and at the same time the block body 222 is retracted by the extension spring 226, which ensures the reliable operation of each cam mechanism.

Figure 15:
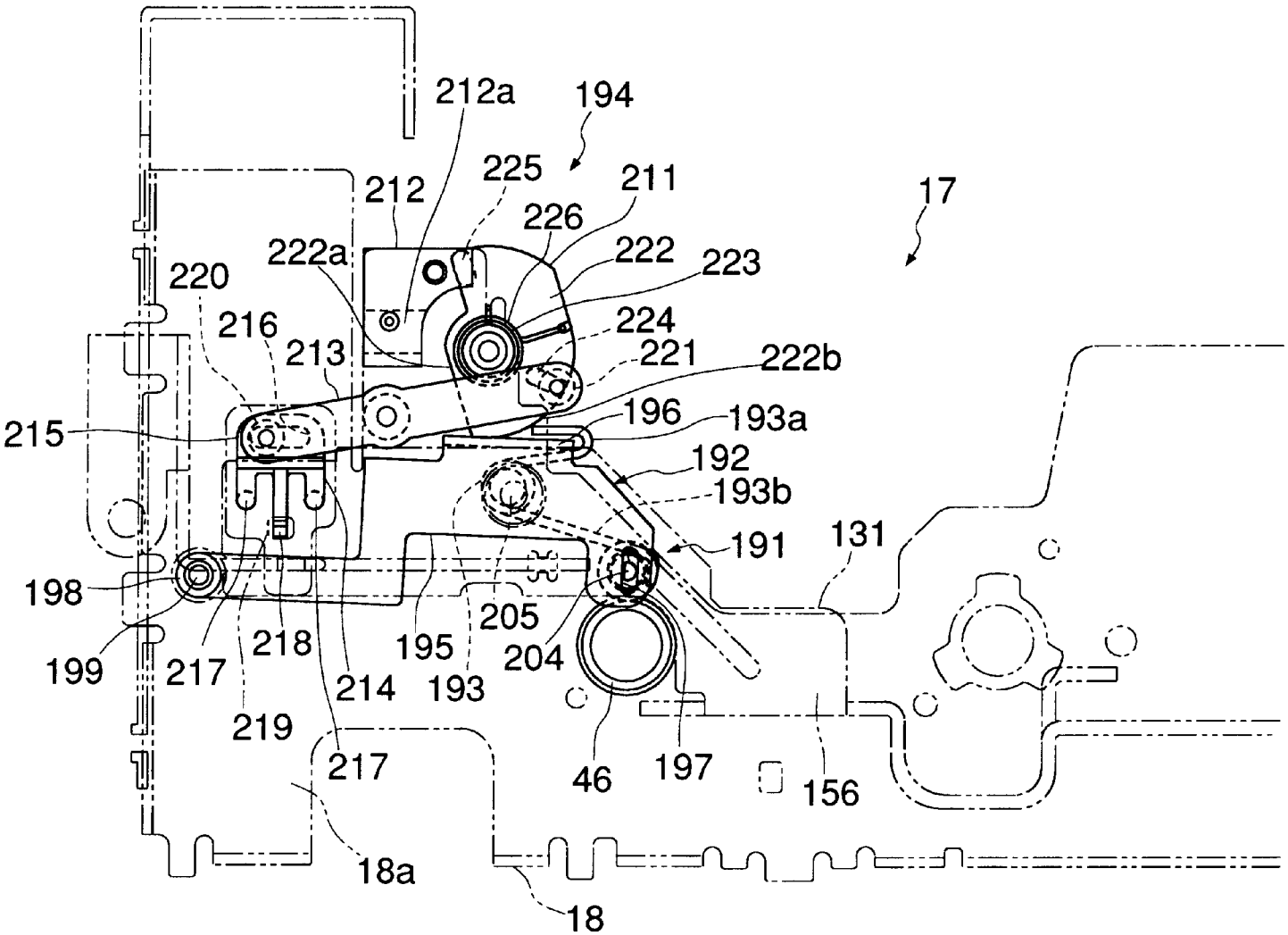
FIG. 15 is a side view of a sub-roller guide mechanism.
Figure 16:
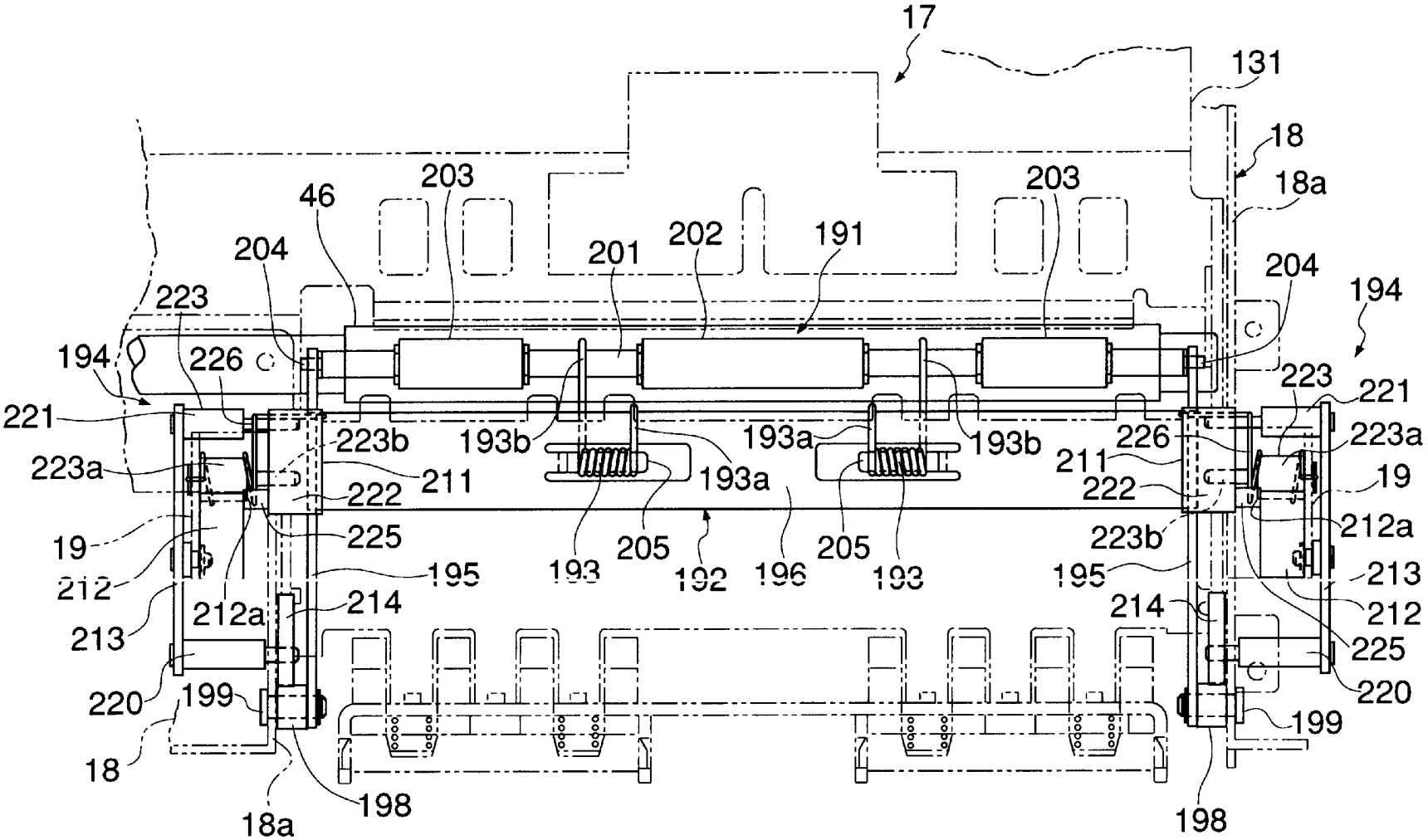
FIG. 16 is a plan view of the sub-roller guide mechanism.

When the block body 222 starts to pivot clockwise, as viewed in FIG. 15, the block body 222 is caused to advance inward by dual cam action between the contact projection 225 of the block body 222 and the cam slope 212*a* of the cam block 212 until it is above the connecting plate 196 of the roller support member 192. When the block body 222 further pivots in the clockwise direction, the chord portion surface 222*b* of the block body 222 is advanced onto the connecting plate 196 and presses the connecting plate 196 from above. Inversely, when the block body 222 in this state starts to pivot counterclockwise, as viewed in FIG. 17, the chord portion surface 222*b* of the block body 222 is separated from the connecting plate 196 and the block body 222 is moved backward or outward by the dual cam action between the contact projection 225 and the cam slope 212*a* and a spring force of the extension spring 226, to be retracted from the connecting plate 196.

Now, a sequence of the whole operation of the sub-roller guide mechanism 17 will be described with reference to FIGS. 15 and 17. When the opened lid 7, as indicated by phantom lines in FIG. 17, starts to be closed, the other end of the lid opening spring 200 starts to be brought to the horizontal position to abut against the top of the latching plate 131. Simultaneously, the roller support member 192 is brought to the horizontal position to bring the sub-driven roller 191 into contact with the laminating drive roller 46. When the closing operation of the lid 7 proceeds to a state immediately before the lid 7 is closed, an interlock mechanism, not shown, is started to thereby pivotally move the latching plate 131 to the printing position in accordance with the final closing operation of the lid 7.

As described above, when the latching plate 131 pivots from the cartridge-inserting position to the printing position, the block body 222 of each urging block 211 pivots and advances transversely to press the roller support member 192 from above. When pressed, the roller support member 192 is slightly depressed to bend the torsion coiled springs 193 through abutment on the sub-driven roller 191, whereby the sub-driven roller 191 is pressed toward the laminating drive roller 46 (see FIG. 15).

On the other hand, when the lid 7 in the state shown in FIG. 15 starts to be opened, the latching plate 131 is pivotally moved from the printing position to the cartridge-inserting position. When the lid 7 is further opened, the other end of the lid opening spring 200 is lifted. At this time, the other end of the lid opening spring 200 is caught in the roller support member 192 to move the same to the retracted position by lifting the roller support member 192.

As described above, the sub-driven roller 191 for rolling on the laminating drive roller 46 is provided in the apparatus body 2 and hence any of the tape cartridge 4*a*, 4*b* largely classified into two types can be used regardless of whether or not the tape cartridge 4 contains a laminating tape. Further, the sub-driven roller 191 can be automatically introduced for operation by the sub-roller guide mechanism 17 only when the tape cartridge 4*b* without a laminating tape is loaded in the apparatus body.

As described above, according to the tape printing apparatus of the invention, a feed driven roller is mounted in a tape cartridge and hence it is possible to simplify the construction of the apparatus body and feed various types of printing tapes with different tape widths in a stable manner. This makes it possible to maintain the quality of characters and the like printed on the tapes.

It is further understood by those skilled in the art that the foregoing are preferred embodiments of the invention, and that various changes and modification may be made without departing from the spirit and scope thereof.

What is claimed is:

1. A tape printing apparatus comprising:

a tape cartridge for containing a roll of printing tape;

an apparatus body for removably mounting said tape cartridge therein;

a printing tape feeder for feeding said printing tape by unwinding said roll of printing tape; and a printing device for printing on said printing tape unwound from said roll of printing tape by an ink jet printing method;

said printing tape feeder comprising:

a feed drive roller arranged in said apparatus body; and a feed driven roller arranged in said tape cartridge;

wherein loading of the tape cartridge in said apparatus body causes said feed driver roller and said feed driven roller to press said printing tape therebetween for feeding said printing tape by rotation thereof.

2. A tape printing apparatus according to claim 1, wherein said tape cartridge has a casing and a casing lid attached to said casing, said feed driven roller being arranged in said casing lid.

3. A tape printing apparatus according to claim 1, including:

a first urging lever arranged in said tape cartridge, for urging said feed driven roller toward said feed drive roller, and a first urging member arranged in said apparatus body, for being brought into contact with said first urging lever when said tape cartridge is loaded in said apparatus body to thereby urge said feed driven roller toward said feed drive roller by way of said first urging lever.

4. A tape printing apparatus according to claim 3, including a feed driven roller support shaft rotatably mounted in said tape cartridge and having said feed driven roller fitted thereon, wherein said first urging lever has one end engaging with said feed driven roller support shaft, another end with which said first urging member is brought into contact, and an intermediate portion at a location closer to said one end than said another end, said first urging lever being mounted in said tape cartridge via said intermediate portion in a manner swingable thereabout.

5. A tape printing apparatus according to claim 1, wherein said tape cartridge further contains a roll of laminating tape, said tape printing apparatus further including a laminating tape-affixing device for affixing said laminating tape to a printed portion of said printing tape while feeding said laminating tape by unwinding said roll of said laminating tape, in synchronism with printing operation of said printing device, said laminating tape-affixing device comprising:

a laminating drive roller arranged in said apparatus body, and a laminating driven roller arranged in said tape cartridge, said laminating drive roller and said laminating driven roller affixing said laminating tape to said printing tape by feeding said laminating tape and said printing tape placed one upon another therebetween by rotation thereof, in said state of said tape cartridge being loaded in said apparatus body.

6. A tape printing apparatus according to claim 5, wherein said laminating driven roller has an outer peripheral surface formed of a hard material.

7. A tape printing apparatus according to claim 5, further including:

a second urging lever arranged in said tape cartridge, for urging said laminating driven roller toward said laminating drive roller, and a second urging member arranged in said tape printing apparatus, for being brought into contact with said second urging lever when said tape cartridge is loaded in said apparatus body to thereby urge said laminating driven roller toward said laminating drive roller by way of said second urging lever.

8. A tape printing apparatus according to claim 7, including a laminating driven roller support shaft rotatably mounted in said tape cartridge and having said laminating driven roller fitted thereon, wherein said second urging lever has one end engaging with said laminating driven roller support shaft, another end with which said second urging member is brought into contact, and an intermediate portion at a location closer to said one end of said second urging lever than said another end of said second urging lever, said second urging lever being mounted in said tape cartridge via said intermediate portion in a manner swingable thereabout.

9. A tape printing apparatus according to claim 1, wherein said tape cartridge includes a cartridge casing forming an outer shell of said tape cartridge, said cartridge casing comprising:

a casing body, and a casing lid attached to said casing body in a manner such that said casing body can be opened and closed, said roll of printing tape being radially mountable in and radially removable from said casing body, in a state of said casing lid being opened.

10. A tape printing apparatus according to claim 1, including:

a tape shaft for supporting said roll of printing tape thereon, a tape shaft holder for supporting said tape shaft, and a tape guide for controlling a lateral position of said printing tape being fed, at least one of said printing tape in relation to said tape shaft and said tape shaft in relation to said tape shaft holder being permitted to perform a slight axial movement.

11. A tape printing apparatus according to claim 10, further including a cutting device for cutting off a printed portion of said printing tape.

12. A tape printing apparatus according to claim 1, including:

a printing tape shaft for supporting said roll of printing tape thereon, a laminating tape shaft for supporting a roll of laminating tape to be affixed to an unwound portion of said printing tape thereon, laminating rollers for feeding said printing tape and said laminating tape while pressing said printing tape and said laminating tape between said laminating rollers, a printing tape guide for controlling a lateral position of said printing tape being fed, and a laminating tape guide for controlling a lateral position of said laminating tape being fed, said printing tape being permitted to perform a slight axial movement with respect to said printing tape shaft, and at the same time said laminating tape being permitted to perform a slight axial movement with respect to said laminating tape shaft.

13. A tape printing apparatus according to claim 12, further including a cutting device for cutting off a printed portion of said printing tape.

14. A tape printing apparatus according to claim 12, wherein said roll of printing tape comprises a tape core supported on said printing tape shaft, and a printing tape body wound around said tape core, and a range of said slight axial movement of said printing tape being limited to an axial clearance between said printing tape shaft and said tape core.

15. A tape printing apparatus according to claim 14, wherein said printing tape shaft comprises a shaft for having said roll of printing tape fitted thereon, a flange for limiting said slight axial movement of said printing tape fitted on said shaft, and a retaining hook formed on a periphery of said shaft, and wherein said axial clearance between said printing tape shaft and said tape core is defined by a distance between one end face of said tape core and an inner surface of said flange opposed to said one end face of said tape core.

16. A tape printing apparatus according to claim 12, wherein said roll of said laminating tape comprises a tape core supported on said laminating tape shaft, and a laminating tape body wound around said tape core, and a range of said slight axial movement of said laminating tape being limited to an axial clearance between said laminating tape shaft and said tape core.

17. A tape printing apparatus according to claim 16, wherein said laminating tape shaft comprises a shaft for having said roll of laminating tape fitted thereon, a flange for limiting said slight axial movement of said laminating tape fitted on said shaft, and a retaining hook formed on a periphery of said shaft, and wherein said axial clearance between said laminating tape shaft and said tape core is defined by a distance between one end face of said tape core and an inner surface of said flange opposed to said one end face of said tape core.

18. A tape cartridge for use with a tape printing apparatus incorporating a feed drive roller for feeding said tape, said tape cartridge containing a tape and being removably loaded in said tape printing apparatus, the tape cartridge comprising;

a cartridge casing;

a feed driven roller arranged in said cartridge casing, for being brought into rolling contact with said feed drive roller to thereby press said tape between said feed driven roller and said feed drive roller to feed said tape by rotation of said feed driven roller and said feed driver roller performed cooperatively, upon and in response to loading of said tape cartridge in said tape printing apparatus; and first urging means arranged in said cartridge casing, for urging said feed driven roller toward said feed drive roller when said tape cartridge is loaded in said tape printing apparatus.

19. A tape cartridge according to claim 18, including a feed driven roller support shaft rotatably supported on said cartridge casing and having said feed driven roller arranged thereon, said first urging means including:

a first urging lever having one end engaging with said feed driven roller support shaft, another end, an intermediate portion at a location closer to said one end than said another end, said first urging lever being mounted in said tape cartridge via said intermediate portion in a manner swingable thereabout, and a first spring provided at said another end of said first urging lever.

20. A tape cartridge according to claim 19, wherein said cartridge casing has a tape-holding block for holding said tape therein, said first urging lever extending longitudinally along a longitudinal side of said printing tape-holding block.

21. A tape cartridge according to claim 19, wherein said feed driven roller is supported on said cartridge so as to be movable between a withdrawn position to which said feed driven roller is withdrawn when said feed driven roller is brought into rolling contact with said feed drive roller upon loading of said tape cartridge into said tape printing apparatus and an advanced position to which said feed driven roller advances when said feed driven roller is detached from said feed drive roller upon removal of said tape cartridge from said tape printing apparatus, said tape cartridge including a tape shaft on which said tape is fitted as a roll and which rotates in unison with said tape, said tape shaft having at least one engaging portion for inhibiting rotation of said roll on said tape shaft, and said first urging lever having a rotation-inhibiting portion for being brought into engagement with said at least one engaging portion when said feed driven roller advances to said advanced position, and being disengaged from said at least one engaging portion when said feed driven roller is withdrawn to said withdrawn position.

22. A tape cartridge according to claim 19, wherein said feed driven roller is supported on said cartridge so as to be movable between a withdrawn position to which said feed driven roller is withdrawn when said feed driven roller is brought into rolling contact with said feed drive roller upon loading of said tape cartridge into said tape printing apparatus and an advanced position to which said feed driven roller advances when said feed driven roller is detached from said feed drive roller upon removal of said tape cartridge from said tape printing apparatus, said feed driven roller pressing an unwound portion of said printing tape between said feed driven roller and said cartridge casing when said feed driven roller is in said advanced position, and releasing said unwound portion when said feed driven roller is brought to said withdrawn position.

23. A tape cartridge according to claim 18, further containing a laminating tape to be affixed to said printing tape, together with said printing tape, said tape printing apparatus having a laminating drive roller arranged therein for feeding said laminating tape, the tape cartridge further comprising:

a laminating driven roller arranged in said cartridge casing, for being brought into rolling contact with said laminating drive roller to thereby press said laminating tape between said laminating driven roller and said laminating drive roller to feed said laminating tape by rotation of said laminating driven roller and said laminating drive roller performed cooperatively, in a state of said tape cartridge being loaded in said tape printing apparatus, and second urging means arranged in said cartridge casing, for urging said laminating driven roller toward said laminating drive roller.

24. A tape cartridge according to claim 23, including a laminating driven roller support shaft rotatably supported on said cartridge casing and having said laminating driven roller arranged thereon, said second urging means including:

a second urging lever having one end engaging with said laminating driven roller support shaft, another end, and an intermediate portion at a location closer to said one end of said second urging lever than said another end of said second urging lever, said second urging lever being mounted in said tape cartridge via said intermediate portion in a manner swingable thereabout, and a second spring provided on said another end of said second urging lever.

25. A tape cartridge according to claim 24, wherein said cartridge casing has a laminating tape-holding block for holding said laminating tape therein, said second urging lever extending longitudinally along a longitudinal side of said laminating tape-holding block.

26. A tape cartridge according to claim 23, including a laminating tape shaft supported on said cartridge casing, for rotation with said laminating tape, and a brake spring in the form of a coil tightly wound around said laminating tape shaft, said brake spring having one end thereof fixed to said ca ridge casing.

27. A tape printing apparatus for use with a tape cartridge that holds a roll of a tape and is removably mounted in said tape printing apparatus, said tape printing apparatus operating to print on said tape by unwinding said tape from said tape cartridge, the tape printing apparatus comprising a feed drive roller rotatable about an axis of rotation for feeding said tape, said tape cartridge comprising:

a cartridge casing;

a feed driven roller rotatable about an axis of rotation and arranged in said cartridge casing, for being brought into rolling contact with said feed drive roller to thereby press said tape between said feed driven roller and said feed drive roller to feed said tape by rotation of said feed driven roller and said feed drive roller performed cooperatively, upon and in response to loading of said tape cartridge in said tape printing apparatus, said tape cartridge being loaded in said tape printing apparatus by relative movement therebetween in a direction generally orthogonal to the axes of rotation of said feed drive roller and said feed driven roller; and first urging means arranged in said cartridge casing, for urging said feed driven roller toward said feed drive roller.

28. A tape cartridge for use with a tape printing apparatus incorporating a feed drive roller for feeding a tape, said tape cartridge containing said tape and being removably loaded in said tape printing apparatus, the tape cartridge comprising:

a cartridge casing;

a feed driven roller arranged in said cartridge casing, for being brought into rolling contact with said feed drive roller to thereby press said tape between said feed driven roller and said feed driver roller to feed said tape by rotation of said feed driven roller and said feed driver roller performed cooperatively, upon and in response to loading of said tape cartridge in said tape printing apparatus; and an urging device arranged in said cartridge casing, for urging said feed driven roller toward said feed drive roller when said tape cartridge is loaded in said tape printing apparatus.

* * * * *